US009484631B1

(12) United States Patent
Napoles et al.

(10) Patent No.: US 9,484,631 B1
(45) Date of Patent: Nov. 1, 2016

(54) SPLIT BAND ANTENNA DESIGN

(71) Applicant: Amazon Technologies, Inc., Seattle, WA (US)

(72) Inventors: Adrian Napoles, Cupertino, CA (US); Ulf Jan Ove Mattsson, Saratoga, CA (US); Anuj Dron, San Jose, CA (US); Tzung-I Lee, San Jose, CA (US); Daejoung Kim, Sunnyvale, CA (US); Morris Yuanhsiang Hsu, Sunnyvale, CA (US); Seng Chin Tai, Rocklin, CA (US)

(73) Assignee: Amazon Technologies, Inc., Seattle, WA (US)

( * ) Notice: Subject to any disclaimer, the term of this patent is extended or adjusted under 35 U.S.C. 154(b) by 58 days.

(21) Appl. No.: 14/557,423

(22) Filed: Dec. 1, 2014

(51) Int. Cl.

| | |
|---|---|
| ***H01Q 1/24*** | (2006.01) |
| ***H01Q 5/50*** | (2015.01) |
| ***H01Q 5/307*** | (2015.01) |
| ***H01Q 5/22*** | (2015.01) |
| ***H01Q 5/20*** | (2015.01) |

(52) U.S. Cl.
CPC ..... *H01Q 5/50* (2015.01); *H01Q 1/243* (2013.01); *H01Q 5/20* (2015.01); *H01Q 5/22* (2015.01); *H01Q 5/307* (2015.01)

(58) Field of Classification Search
CPC ..... H01Q 5/30; H01Q 5/307; H01Q 1/243; H01Q 1/50
USPC ..... 343/702, 850, 852
See application file for complete search history.

(56) References Cited

U.S. PATENT DOCUMENTS

| | | | | |
|---|---|---|---|---|
| 7,859,468 | B2 * | 12/2010 | Ali | H01Q 1/243 343/702 |
| 7,917,096 | B2 * | 3/2011 | Wilcox | H04B 1/0458 333/124 |
| 8,791,864 | B2 * | 7/2014 | Merz | H01Q 1/243 343/702 |
| 8,890,753 | B1 * | 11/2014 | Lee | H01Q 1/243 343/702 |
| 2015/0054701 | A1 * | 2/2015 | Kim | H01Q 9/0442 343/750 |

* cited by examiner

*Primary Examiner* — Hoang V Nguyen
(74) *Attorney, Agent, or Firm* — Lowenstein Sandler LLP

(57) ABSTRACT

Antenna structures and methods of operating the same of an electronic device are described. One apparatus includes a single radio frequency (RF) feed and a folded monopole element coupled to the single RF feed. The folded monopole element is an integrated WAN/GNSS antenna that receives electromagnetic energy in a first frequency band and receives electromagnetic energy in a second frequency band. The first frequency band is a wireless area network (WAN) frequency band and the second frequency band is a global navigation satellite system (GNSS) frequency band. The apparatus further includes an impedance matching circuit coupled to the single RF feed. The impedance matching circuit includes a diplexer to extract out GNSS frequency signals received by the folded monopole element from WAN signals received by the folded monopole element.

18 Claims, 27 Drawing Sheets

Matching Components of Main MB/HB Antenna

1600

SPLIT BAND ANTENNA DESIGN

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

All consumer portable devices need to meet the FCC's SAR requirement. SAR is a measure of the rate at which energy is absorbed by the body when exposed to a radio frequency (RF) electromagnetic field. In addition, the user's body can block the RF electromagnetic field in the direction of the user's body, thus reducing the gain in that direction.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
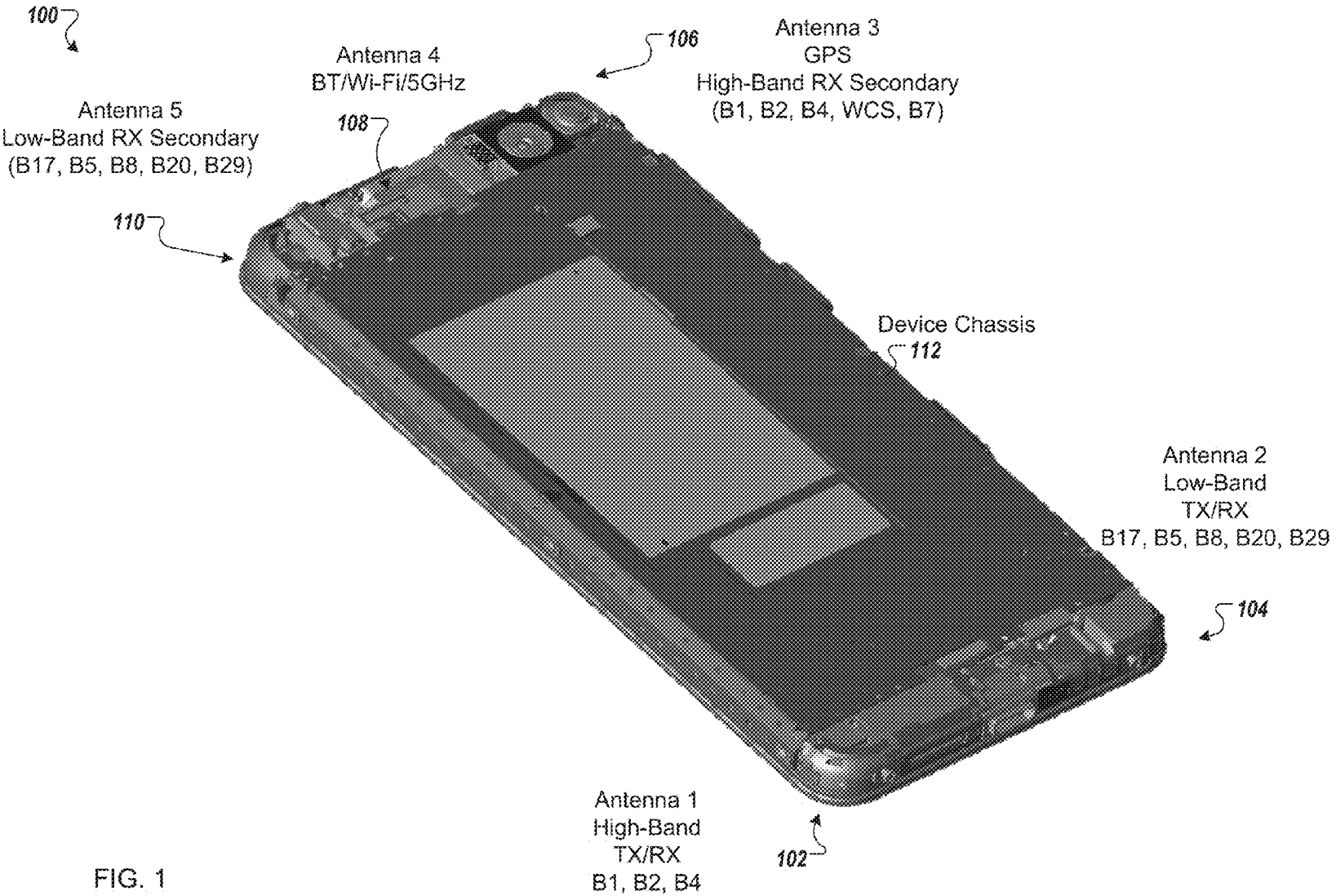
FIG. 1 is a rear view of a user device with five antenna structures according to one embodiment.

Antenna structures and methods of operating the same of an electronic device are described. One apparatus includes a single radio frequency (RF) feed and a folded monopole element coupled to the single RF feed. The folded monopole element is an integrated WAN/GNSS antenna that radiates electromagnetic energy in a first frequency band and radiates electromagnetic energy in a second frequency band. The first frequency band is a wireless area network (WAN) frequency band and the second frequency band is a global navigation satellite system (GNSS) frequency band. The apparatus further includes an impedance matching circuit coupled to the single RF feed. The impedance matching circuit includes a diplexer to extract out GNSS frequency signals received by the folded monopole element from WAN signals received by the folded monopole element. The folded monopole element radiating within the first frequency range permits communications in a first set of operating bands, including at least one of band 1, band 2, band 4, wireless communication service (WCS) and band 7 of Long Term Evolution (LTE) networks. The folded monopole element radiating within the second frequency range permits reception of GPS signals. The high-band antenna element radiating within the first frequency range, as described herein, permits communications in a third set of operating bands, including at least band 1, band 2, and band 4. The-low-band antenna element radiating within the third frequency band, as described herein, permits communications in a fourth set of operating bands, including at least band 17, band 5, band 8, band 20, and band 29.

The antenna structures described herein can be used for Long Term Evolution (LTE) frequency bands, third generation (3G) frequency bands, Wi-Fi® and Bluetooth® frequency bands or other wireless local area network (WLAN) frequency bands, wide area network (WAN) frequency bands, global positioning system (GPS) frequency bands, or the like.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 2:
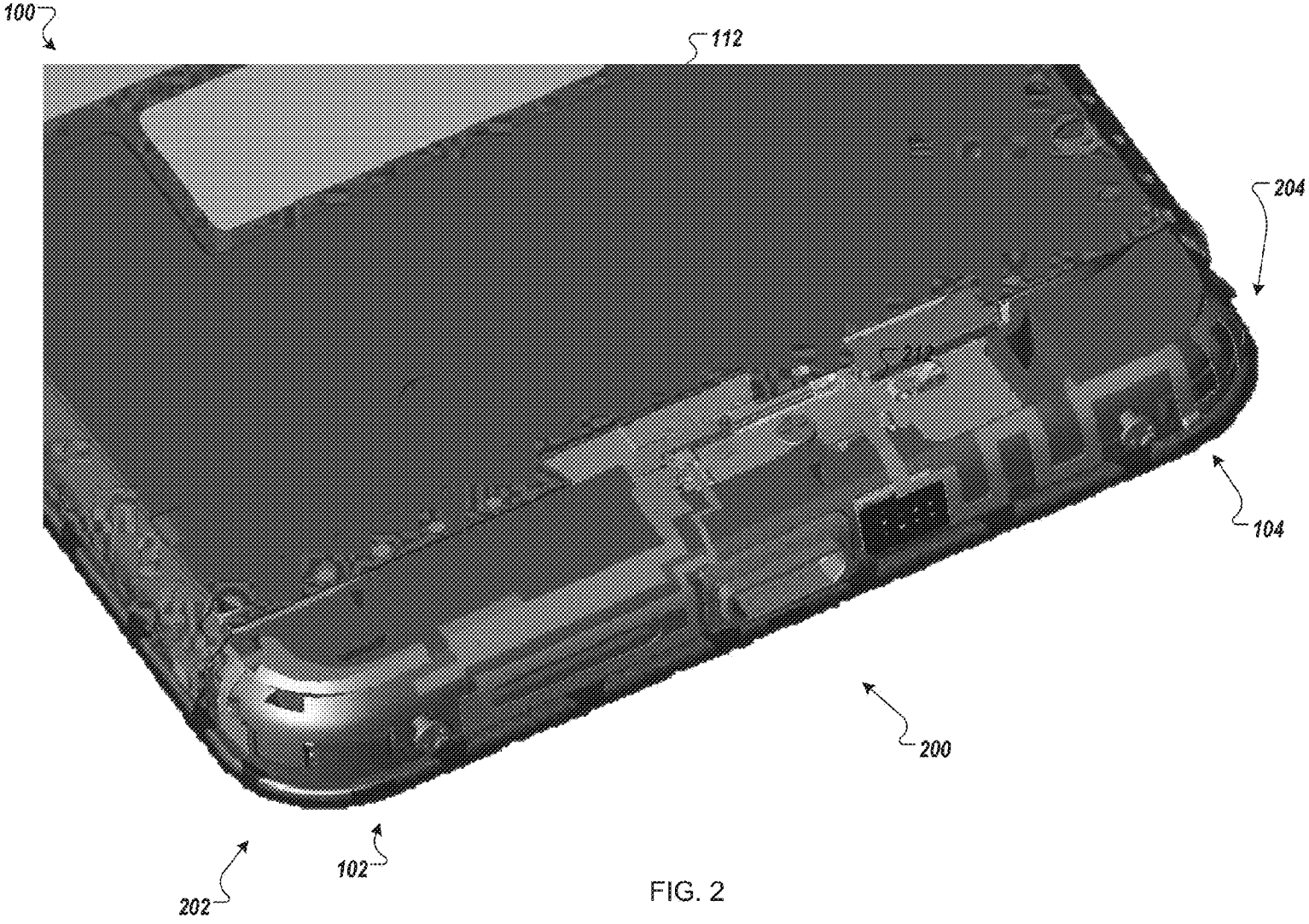
FIG. 2 is a rear view of a bottom side of the user device with first and second antennas according to one embodiment.
Figure 3:
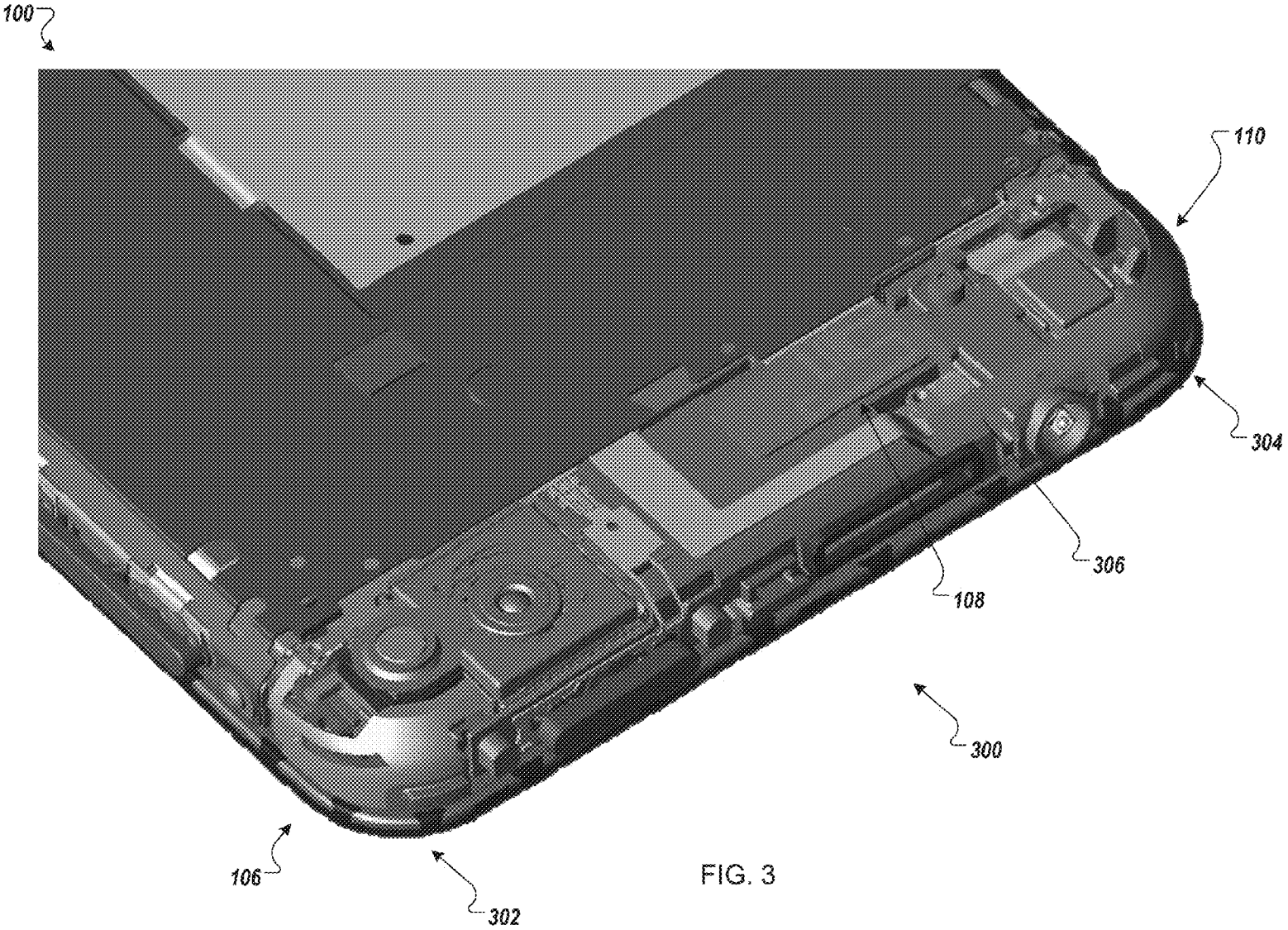
FIG. 3 is a rear view of a top side of the user device with third, fourth and fifth antennas according to one embodiment.

FIGS. 1-3 provide an overview of a user device with an antenna system design that supports various air interface technologies, including wireless area network (WAN), wireless local area network (WLAN), personal area network (PAN), and Global Navigation Satellite System (GNSS) technologies in a single user device design for different global markets. The WAN technologies supported may include 4G data over Long Term Evolution (LTE) with carrier aggregation of 3G data and voice, as well as 2G. The antenna system can be categorized into two broad categories: WAN antennas and Auxiliary antennas. The WAN main and diversity antennas are used to cover multiple 4G and 3G bands (total 9 bands for a US-based device). The antenna size vs. bandwidth/efficiency trade-off imposes a challenge of designing wide bandwidth antennas with acceptable radiation efficiency in a very constrained space. The different wireless connectivity technologies may impose their own unique requirements on the implementation of all the auxiliary antennas. The narrow profile of the user device may further impose a level of design and integration complexity that makes antenna development a very challenging task. Additionally, carrier and regulatory compliance requirements such as spurious emissions, specific absorption rate (SAR), hearing-aid compatibility (HAC), etc. with simultaneous multi-mode operation have to be met. In some embodiments, some antenna elements are manufactured using the Laser Direct Structuring (LDS) method and some antenna elements (e.g., WLAN/PAN antenna for BT/Wi-Fi/5 GHz) are manufactured with flex circuit technology. The LDS antenna elements may be embedded into a rear housing (also referred to as a device chassis) by an over-molding process.

Multi-Antenna User Device

FIG. 1 is a rear view of a user device 100 with five antenna structures according to one embodiment. The antenna system includes: Main WAN antenna, Secondary WAN antenna (diversity antenna) with GPS/GNSS bands, WLAN/PAN antenna (2.4 GHz & 5 GHz dual-band Wi-Fi® bands & Bluetooth® band). In particular, the user device 100 includes a first antenna 102 (Primary high-band Antenna 1 for transmit (TX) and receive (RX)), a second antenna 104 (Primary low-band Antenna 2 for TX/RX), a third antenna 106 (Antenna 3, Integrated Secondary High-band RX/GPS antenna for MIMO and Diversity), a fourth antenna 108 (Antenna 4 WLAN/PAN antenna (2.4 GHz & 5 GHz dual-band Wi-Fi® bands & Bluetooth® band) and a fifth antenna 110 (Secondary low-band RX Antenna 5 for MIMO and Diversity). In another embodiment, the user device 100 includes a sixth near field communication (NFC) antenna (not illustrated in FIG. 1) located at a rear side of the user device, such as under a plastic insert within an opening in a device chassis 112. The user device 100 may also include a RFID tag (not illustrated). In other embodiments, other types of antennas may be used. The first antenna 102 may be referred to as a high-band WAN primary antenna and the second antenna 104 may be referred to as a low-band WAN primary antenna. The third antenna 106 may be referred to as an integrated high-band WAN secondary RX and GPS antenna, the fourth antenna 108 may be referred to as a wireless local area network (WLAN) antenna, and the fifth antenna 110 may be referred to as a low-band WAN secondary antenna.

In one embodiment, the antenna system of the user device 105 may cover the following frequency bands listed in the following table.

| | Frequency Bands | | | |
|---|---|---|---|---|
| | GSM-band | 3G-band | LTE-band | CA (DL-UL) |
| Coverage Frequencies | GSM 850<br>PCS 1900 | Band 2<br>Band 5 | Band 2<br>Band 4<br>Band 5<br>Band 17<br>Band 28 (FLO) | Band 17-Band4<br>Band 17-Band 2<br>Band 2-Band 17<br>FLO-Band 17 |
| Roaming Frequencies | EGSM 900<br>DCS 1800 | Band 1<br>Band 8 | | |
| Coverage Frequencies | EGSM 900<br>DCS 1800 | Band 1<br>Band 8 | Band 3<br>Band 7<br>Band 8<br>Band 20 | |
| Roaming Frequencies | GSM 850<br>PCS 1900 | Band 2<br>Band 5 | Band 13 | |

For purposes of description, when antenna locations are discussed, it is with respect to looking at the user device 100 from a back side (an opposite side of a display on a front side) with a top edge of the user device 100 pointing upwards to the sky. The primary TX/RX antenna elements (e.g., first antenna 102 and second antenna 104), also sometimes referred to as the main antenna, is located at a bottom side 200 of the user device 100, as illustrated in FIG.

2, while the secondary RX antenna elements (e.g., third antenna 106 and fifth antenna 110) are located at a top side 300 of the user device 100, as illustrated in FIG. 3. As described in more detail below, the high-band secondary antenna 106 also functions as the GPS antenna element via the use of a GPS extractor.

FIG. 2 is a rear view of the bottom side 200 of the user device 100 with first and second antennas according to one embodiment. The primary or main antenna is made up of two elements, a high-band element 102 (Antenna 1) located at a first corner 202 of the bottom side 200, and a low-band element 104 (Antenna 2) located at a second corner 204 of the bottom side 200. As illustrated in FIG. 2, the primary antenna is split into two separate antenna elements with separate RF feeds to facilitate impedance matching for the two antenna elements. Splitting the primary antenna into two separate elements with separate RF feeds allows a better match to be obtained since the matching circuit only has to operate at a single band (low or high). The first antenna 102 can operate at both mid-band (MB) and high-band (HB) frequencies with one impedance matching network coupled to one RF feed, and the second antenna 104 can operate at the low-band (LB) with another impedance matching network coupled to another RF feed. The same reasoning was applied for the secondary RX antennas, illustrated in FIG. 3.

FIG. 3 is a rear view of a top side 300 of the user device 100 with third, fourth and fifth antennas according to one embodiment. The secondary antenna is made up of two elements, a high-band element 106 (Antenna 3) located at a third corner 302 of the top side 300, and a low-band element 110 (Antenna 5) located at a fourth corner 304 of the top side 300. The high-band element 106 (Antenna 3) may operate as the secondary high-band RX antenna element, as well as a GPS element. Also located at the top side 300 is the fourth antenna 108 that operates as a WLAN/PAN antenna (e.g., Bluetooth®/Wi-Fi®/5 GHz frequency bands). As illustrated in FIG. 3, the secondary antenna is split into at least two frequency bands to facilitate impedance matching for the two frequency bands. The low-band secondary RX antenna 110 is a loop element fed along a top edge 306 of the user device 100, while the secondary high-band element 106 is a folded monopole located on the opposite side of the top side 300.

The user device 100 can cover various frequency bands using the five antennas, such as follows: frequency bands B1, B2, B4 by Antenna 1 102; frequency bands B17, B5, B8, B20, B29 by Antenna 2 104; frequency bands B1, B2, B4, Wireless Communication Service (WCS), B7 by Antenna 3 106; frequency bands Bluetooth®/Wi-Fi®/5 GHz frequency bands by Antenna 4 108; and frequency bands B17, B5, B8, B20, B29 by Antenna 5 110.

Primary Antenna: Antenna 1 High-Band Tx/Rx

Figure 4:
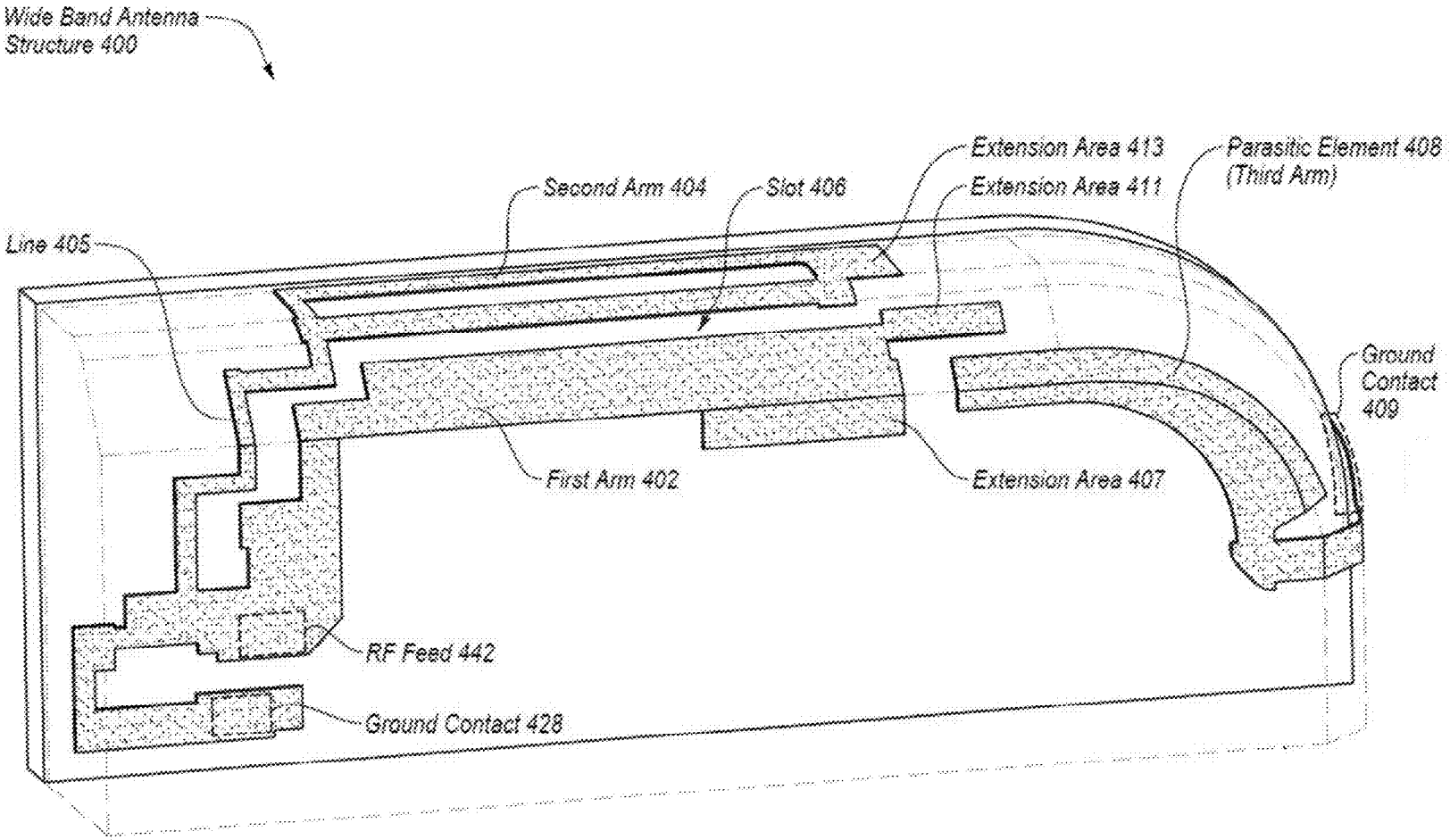
FIG. 4 is a perspective view of a wideband dual-arm antenna for a high-band primary antenna according to one embodiment.

The primary antenna 1 102, which is the high-band element of the primary or main antenna located at the first corner 202 of the bottom side is a wideband dual-arm antenna. The wideband antenna may include a first feeding arm coupled to a radio frequency (RF) feed and a second feeding arm coupled to the RF feed. At least a portion of the second feeding arm is parallel to the first feeding arm. The wideband dual-arm antenna further includes a third arm coupled to the ground plane. The third arm is a parasitic ground element that forms a coupling to the first feeding arm and the second feeding arm. The parasitic element increases a bandwidth of the wideband antenna. Another wideband dual-arm antenna further includes a grounding line coupled to the ground plane to electrically short the first feeding arm to the ground plane to form an inverted-F antenna (IFA), such as illustrated in FIG. 4. The wideband dual-arm antenna can be used in a compact single-feed configuration in various portable electronic devices, such as a tablet computer, mobile phones, personal data assistances, electronic readers (e-readers), or the like. In a single-feed antenna, both bandwidth and efficiency in the high-band can be limited by the space availability and coupling between the high-band antenna and the low-band antenna in a compact electronic device. The wideband dual-arm antenna can be used to improve radiation efficiency in desired frequency bands. The wideband dual-arm antenna can be used for wide band performance for Long Term Evolution (LTE) frequency bands, third generation (3G) frequency bands, or the like. In one implementation, the wideband dual-arm antenna can be configured to operate with multiple resonances in the 3G/LTE frequency bands.

The ground plane may be various parts of metal interconnected so that the metal appears to be one solid piece of metal to the antenna elements. The ground plane of the user device may be made up of metal from the device chassis 112, PCB, display housing, flexible grounding components, as well as grounding pieces for various components of the user device, such as cameras, audio components, USB ports, vibrators, touch keys, or the like.

FIG. 4 is a perspective view of a wideband dual-arm antenna 400 for a high-band primary antenna according to one embodiment. The wideband dual-arm antenna 400 can be disposed in an electronic device that includes circuitry that drives a single radiation frequency (RF) feed 442. In FIG. 4, the ground is represented as a radiation ground plane. The ground plane may be a metal frame of the electronic device, such as the device chassis 112 illustrated in FIG. 1. The ground plane may be a system ground or one of multiple grounds of the user device. The single RF feed 442 may be a feed line connector that couples the wideband dual-arm antenna 400 to a respective transmission line of the electronic device. The single RF feed 442 is a physical connection that carries the RF signals to and/or from the wideband dual-arm antenna 400. The feed line connector may be any type of feeds, such as the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the wideband dual-arm antenna 400. In another embodiment, the feed line connection is connected to the wideband dual-arm antenna with an impedance matching network. The single RF feed 442 is coupled to the wideband dual-arm antenna 400 at a first end of the wideband dual-arm antenna 400.

In one embodiment, the wideband dual-arm antenna 400 is disposed on an antenna carrier, such as a dielectric carrier of the electronic device. The antenna carrier may be any non-conductive material, such as dielectric material, upon which the conductive material of the wideband dual-arm antenna 400 can be disposed without making electrical contact with other metal of the electronic device. In another embodiment, the wideband dual-arm antenna 400 is disposed on, within, or in connection with a circuit board, such as a printed circuit board (PCB). In one embodiment, the ground plane may be a metal chassis of a circuit board. Alternatively, the wideband dual-arm antenna 400 may be disposed on other components of the electronic device or within the electronic device. It should be noted that the wideband dual-arm antenna 400 illustrated in FIG. 4 is a three-dimensional (3D) structure. However, as described herein, the wideband dual-arm antenna 400 may include two-dimensional (2D) structures, as well as other variations than those depicted in FIG. 4.

The wideband dual-arm antenna 400 includes a first feeding arm 402, a second feeding arm 404, and a third arm 408. The third arm 408 is a parasitic element and is referred to hereinafter as the parasitic element 408. A single RF feed 442 is coupled to a first end of the wideband dual-arm antenna 400. In particular, the single RF feed 442 is coupled to a first end of the first feeding arm 402. The first feeding arm 402 may be formed by one or more conductive traces. For example, a first portion of the first feeding arm 402 extends in a first direction from the single RF feed 442 until a first fold and a second portion extends from the first fold in a second direction. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device. The single RF feed 442 is also coupled to a first end of the second feeding arm 404. The second feeding arm 404 may be formed by one or more conductive traces. For example, a line 405 is coupled to the RF feed and a third portion is coupled to the line and extends in the second direction. The third portion is parallel to the second portion of the first feeding arm 402. In one embodiment, the second feeding arm 404 is parallel to the first feeding arm 402 in its entirety and does not include any portion that is perpendicular to corresponding portions of the first feeding arm 402. In other embodiments, some portions of the second feeding arm 404 are parallel to corresponding portions of the first feeding arm 402. In the depicted embodiment, the third portion of the second feeding arm 404 that is folded onto a second side of the antenna carrier. In one embodiment, the first feeding arm 402 is disposed on a first plane on a first side of the antenna carrier 410 (e.g., a rear side) and one or more portions of the second feeding arm 404, the parasitic element 408, or of both are disposed on one or more additional planes, such as on a second side of the antenna carrier (e.g., a top side). This can be done to fit the wideband dual-arm antenna structure in a smaller volume while maintaining the overall length of the second feeding arm 404 or other portions of the antenna structure.

The parasitic element 408 includes a fourth portion coupled to a ground contact 409, which is coupled to the ground plane. The fourth portion extends from the ground contact 409 and forms a gap between a distal end of the second portion of the first feeding arm 402, the distal end being the farthest from the single RF feed 442. That is the fourth portion is disposed to form a gap between a distal end of the first feeding arm 402, the distal end being an end of the first feeding arm 402 that is farthest from the single RF feed 442. The proximity of the parasitic element 408 to the distal end forms a coupling between the parasitic element 408 and the first feeding arm 402. When driven by the single RF feed 442, the first feeding arm 402 parasitically induces current on the parasitic element 408 that is coupled to the ground plane (i.e., via ground contact 409). Although there is a gap between the conductive traces, the parasitic element 408 is in close enough proximity to form a close coupling (also referred to herein as "coupling"), such as a capacitive coupling or an inductive coupling, between the parasitic element 408 and the dual-arm antenna element (e.g., first feeding arm 402 and second feeding arm 404). The presence of the parasitic element 408 can change the first feeding arm 402, which is a monopole antenna, into a coupled monopole antenna. A parasitic element is an element of the wideband dual-arm antenna 400 that is not driven directly by the single RF feed 442. Rather, the single RF feed 442 directly drives another element of the wideband dual-arm antenna 400 (e.g., the first feeding arm 402 and second feeding arm 404), which parasitically induces a current on the parasitic element 408. In particular, by directly applying current on the other element by the single RF feed 442, the directly-fed element radiates electromagnetic energy, which induces another current on the parasitic element to also radiate electromagnetic energy. In the depicted embodiment, the parasitic element 408 is parasitic because it is physically separated from the first feeding arm 402 and the second feeding arm 404, which are driven at the single RF feed 442, but the parasitic element 408 forms a coupling between these antenna elements. For example, the first feeding arm 402 (and/or second feeding arm 1404) parasitically excites the current flow of the parasitic element 408. By coupling the driven element and the passive element, additional resonant modes can be created or existing resonant modes can be improved, such as decreasing the reflection coefficient or extending the bandwidth. In another embodiment, a tunable element (not illustrated) is coupled between the ground contact 409 and the ground plane. The tunable element can be used to tune the resonant frequency of the parasitic element 408.

The second feeding arm 404 is disposed to form a slot 406 between the second feeding arm 404 and the first feeding arm 402. In the depicted embodiment, the second feeding arm 404 also includes an opening (not labeled) in the middle of the third portion. The opening in the middle of the third portion can be used to accommodate other components of the user device, such as a speaker or a microphone. In another embodiment, the third portion can be continuous conductive material and not have an opening as illustrated. The line 405 may be a meandering line that follows the upper perimeter of the first feeding arm 402. The meandering line can be disposed to be parallel to the corresponding folds and bends of the first and second portions of the first feeding arm 402. The slot 406 between the first feeding arm 402 and the second feeding arm 404 can be carefully designed to achieve the wide bandwidth as described herein. The first feeding arm 402 contributes to resonance frequencies of a first resonant mode (mid-band), the parasitic element 408 contributes to resonance frequencies of a second resonant mode (high-band) and the second feeding arm 404 expands a bandwidth between the first resonant mode and the second resonant mode. That is, the second feeding arm 404 increases efficiency of the resonance frequencies of the first resonant mode and second resonant mode to expand the bandwidth of the wideband dual-arm antenna 400. For example, the wideband dual-arm antenna 400 can be configured to operate in a frequency range of approximately 1.7 GHz to approximately 2.7 GHz, and the second feeding arm 404 is disposed to form the slot 406, which expands the bandwidth between about 1.7 GHz and about 2.7 GHz. The parasitic element 408 may also contribute to impedance matching of the mid-band (e.g., about 1.7 GHz) of the first feeding arm 402. For another example, the wideband dual-arm antenna 400 can be configured to operate in a frequency range of approximately 1.7 GHz to approximately 3.5 GHz, and the second feeding arm 404 is disposed to form the slot 406, which expands the bandwidth between about 1.7 GHz and about 3.5 GHz. The parasitic element 408 may also contribute to impedance matching of the mid-band (e.g., about 1.7 GHz) of the first feeding arm 402. In another embodiment, the antenna structure 4100 can be configured to operate in a frequency range of approximately 1.7 GHz to approximately 6 GHz.

The depicted antenna structure (e.g., wideband dual-arm antenna 400) can use two resonant modes to cover a range of about 1.7 GHz to about 2.7 GHz. In other embodiments, additional resonant modes can be achieved. Also, in other embodiments, the frequency range may be between approximately 1.7 GHz and approximately 6 GHz. In another embodiment, the antenna structure can be tuned to operate at approximately 3.5 GHz.

In a further embodiment, as illustrated in FIG. 4, the first feeding arm 402 includes a first extension area 407 coupled to a first side of the second portion of the first feeding arm 402 and a second extension area 411 coupled to a second side of the second portion of the first feeding arm 402. The second extension area 411 is coupled to a distal end of the first feeding arm 402, the distal end being an end farthest from the RF feed 142. The first extension area 407 contributes to an impedance matching of the first feeding arm 402. The second extension area 411 contributes to the impedance matching and an effective length of the first feeding arm 402. The first extension area 407 can be used to contribute to impedance matching, as well as to increase the close coupling with the parasitic element 408. The second extension area 411 can be used to tune the resonance of the first feeding arm 402 by changing the effective length of the first feeding arm 402. The second extension area 411 can also contribute to impedance matching. In a further embodiment, as illustrated in FIG. 4, the second feeding arm 404 includes an extension area 413 coupled to a side of the third portion of the second feeding arm 404. The extension area 413 can be used to contribute to tuning the resonance of the second arm 4024 by changing the effective length of the second feeding arm 404. The extension area 413 can also contribute to impedance matching. In another embodiment, the wideband dual-arm antenna 400 may include one or more additional arms, slots (not illustrated) or notches (not illustrated) for one or more additional resonant modes.

In this embodiment, the wideband dual-arm antenna 400 is a 3D structure as illustrated in the perspective view of FIG. 4. In other embodiments, the second feeding arm 404 and parasitic element 408 are 3D structures that wrap around different sides of the antenna carrier and the first feeding arm 402 is a 2D structure disposed on a front side of the antenna carrier. Of course, other variations of layout may be used for the first feeding arm 402, second feeding arm 404 and the parasitic element 408. It should also be noted that various shapes for the wideband dual-arm antenna 400 are possible. For example, the wideband dual-arm antenna structure can have various bends, such as to accommodate placement of other components, such as a speakers, microphones, USB ports.

The dimensions of the wideband dual-arm antenna 400 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another. The wideband dual-arm antenna 400 may have various dimensions based on the various design factors. The first feeding arm 402 has a first effective length that is roughly the distance between the single RF feed 442 along the conductive trace(s). In one embodiment, the wideband dual-arm antenna 400 has an overall height ($h_4$), an overall width ($W_4$), and an overall depth ($d_4$). The overall height ($h_4$) may vary, but, in one embodiment, is about 9 mm. The overall width ($W_4$) may vary, but, in one embodiment, is about 30 mm. The overall depth ($d_4$) may vary, but, in one embodiment, is about 5 mm. The first feeding arm 402 has a width ($W_1$) that may vary, but, in one embodiment, 17×mm. The first feeding arm 402 has a height ($h_1$) that may vary, but, in one embodiment, is 6 mm. The first feeding arm 402 has a first effective length that may vary, but, in one embodiment, is 24 mm. The second feeding arm 404 has a width ($W_2$) that may vary, but, in one embodiment, is 12 mm. The second feeding arm 404 has a height ($h_4$) that may vary, but, in one embodiment, is 9 mm. The second feeding arm 404 has a depth ($d_2$) that may vary, but, in one embodiment, is 4 mm. The second feeding arm 404 has a second effective length that may vary, but, in one embodiment, is 30 mm. The slot 406 has a height (not labeled) that may vary, but, in one embodiment, is 3 mm. The slot 406 has a width (not labeled) that may vary, but, in one embodiment, is 12 mm (e.g., the width of the second arm ($W_2$). The parasitic element 408 has a width ($W_3$) that may vary, but, in one embodiment, is 6 mm. The parasitic element 408 has a height ($h_1$) that may vary, but, in one embodiment, is 6 mm. The parasitic element 408 has a third effective length that may vary, but, in one embodiment, is 12 mm. Alternatively, other dimensions may be used for the wideband dual-arm antenna 400.

As described herein, strong resonances are not easily achieved within a compact space within user devices, especially within the spaces on smart phones and tablets. The structure of the wideband dual-arm antenna 400 of FIG. 4 provides strong resonances at a first frequency of approximately 1.7 GHz (MB) and at a second frequency of approximately 2.7 GHz (HB). Alternatively, the structure of the wideband dual-arm antenna 400 provides strong resonances at other frequency ranges, such as between approximately 1.7 GHz and approximately 3.5 GHz. These resonances can be operated in separate modes or may be operated simultaneously. These multiple strong resonances can provide an improved antenna design as compared to conventional designs. In one embodiment, the wideband dual-arm antenna 400 illustrated in FIG. 4 is configured to radiate electromagnetic energy in a first frequency range (e.g., mid-band) and in a second frequency range (e.g., high-band). The second frequency range is higher than the first frequency range. Both the first frequency range and the second frequency range may include one or more WAN frequency bands as described herein. In one embodiment, the wideband dual-arm antenna 400 can operate between the first frequency range and the second frequency range, such as the frequency range between about 1.7 GHz to about 2.7 GHz. In one embodiment, the wideband dual-arm antenna 400 can operate between the first frequency range and the second frequency range, such as the frequency range between about 1.7 GHz to about 3.5 GHz. The embodiments described herein are not limited to use in these frequency ranges, but could be used to increase the bandwidth of a multi-band frequency in other frequency ranges, as described herein. The antenna structure may be configured to operate in multiple resonant modes as described herein.

The wideband dual-arm antenna 400 may be configured to operate in multiple resonant modes. For example, in another embodiment, the antenna structure may include one or more additional arm elements, slot antennas in the antenna structure or notches to create one or more additional resonant modes. In another embodiment, the antenna structure may include additional parasitic elements, such as a parasitic ground element (e.g., a monopole that extends from the ground plane that couples to the other antenna elements), to create an additional resonant mode. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a single-feed antenna with increased bandwidth in a size that is conducive to being used in a user device.

Figure 5:
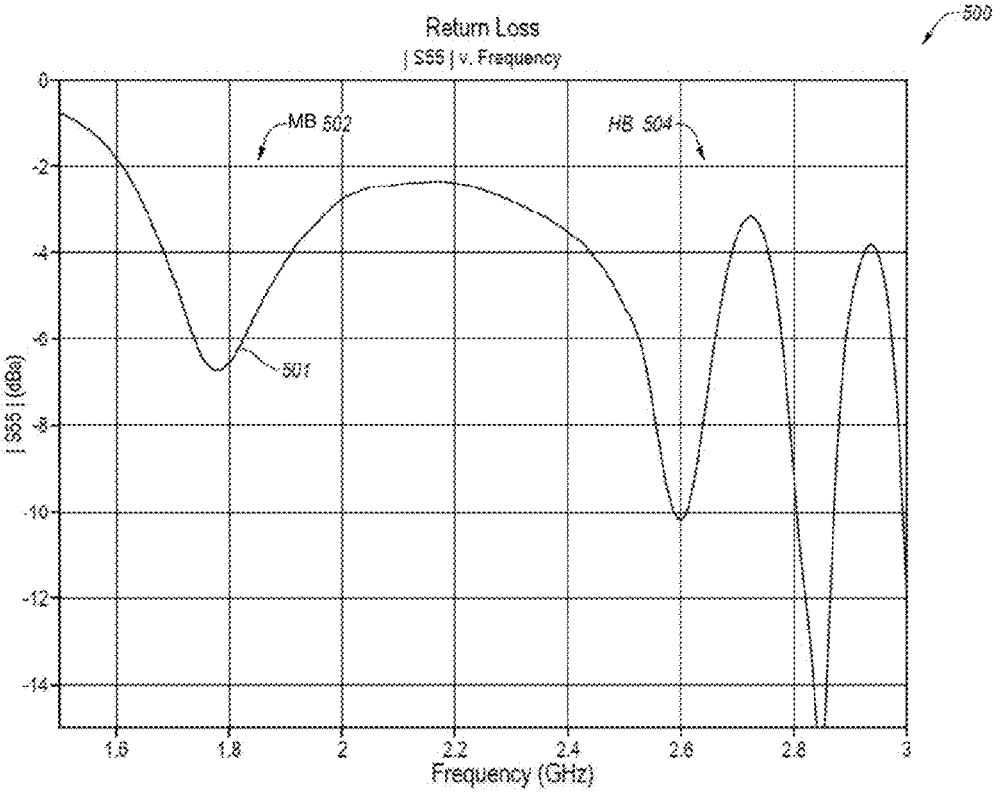
FIG. 5 is a graph of return loss of the wideband dual-arm antenna of FIG. 4 according to one embodiment.

FIG. 5 is a graph 500 of return loss of the wideband dual-arm antenna 400 of FIG. 4 according to one embodiment. The graph 500 shows the return loss 501 of the wideband dual-arm antenna 400 of FIG. 4. The graph 500 illustrates that the wideband dual-arm antenna 400 can be caused to radiate electromagnetic energy between approximately 1.69 GHz to approximately 3 GHz. In the mid-band (MB) 502, the wideband dual-arm antenna 400 can operate between approximately 1.69 GHz and approximately 2.2 GHz. In the high-band (HB) 504, the wideband dual-arm antenna 400 can operate between approximately 2.2 GHz to approximately 3 GHz. The wideband dual-arm antenna 400 provides at least four resonant modes, including one in the mid-band 502 at approximately 1.75 GHz and three in the high-band 504 at approximately 2.6 GHz, at approximately 2.85 GHz and at approximately 3 GHz in the high-band 504. As described herein, the wideband antenna 400 can operate between approximately 1.7 GHz and approximately 2.7 GHz. As described herein, other resonant modes may be achieved and the resonant modes may cover different frequency ranges and may be centered at different frequencies than those described and illustrated herein. In one embodiment, the MB/HB antenna return loss with two lumped element matching components (series C and shunt L) in free space show a very wideband and return loss matching from 1.71 GHz at −7.1 dB and 2.69 GHz at −6.8 dB.

Figure 6:
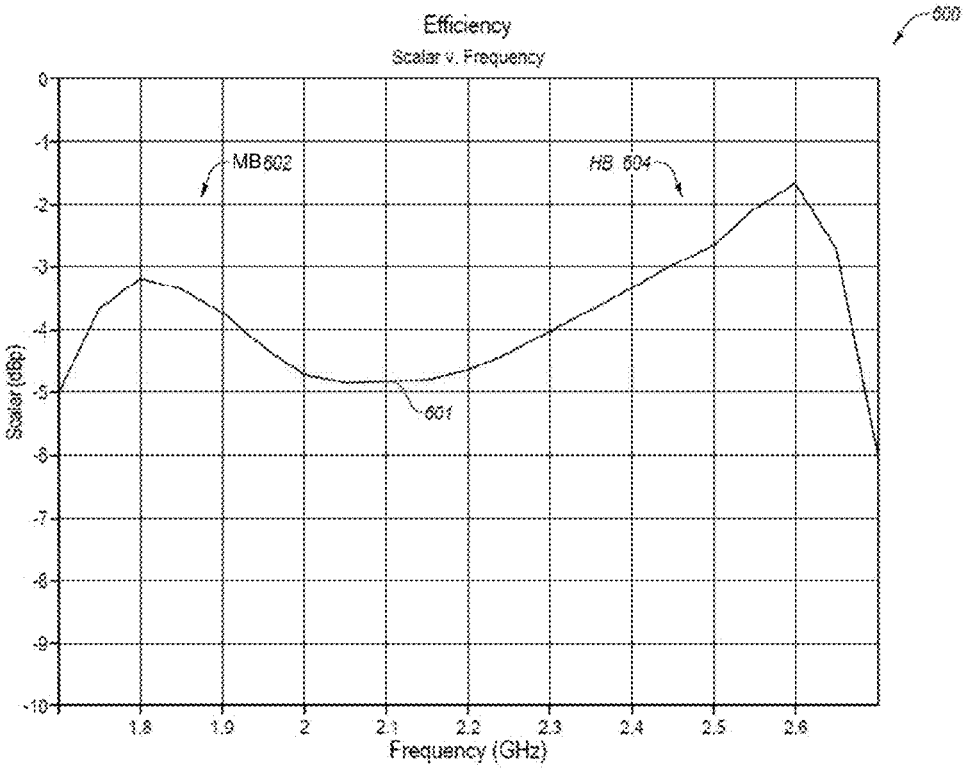
FIG. 6 is a graph of measured efficiency of the wideband dual-arm antenna of FIG. 4 according to one embodiment.

FIG. 6 is a graph 600 of measured efficiency 601 of the wideband dual-arm antenna 400 of FIG. 4 according to one embodiment. The graph 600 illustrates the total efficiency 601 over a frequency range in the mid-band 602 and over a frequency range in the high-band 604. The total efficiency 601 of the antenna can be measured by including the loss of the structure (e.g., due to mismatch loss), dielectric loss, and radiation loss. The graph 600 illustrates that the wideband dual-arm antenna 400 is a viable antenna for the frequency range between approximately 1.7 GHz in the mid-band 602 and approximately 2.7 GHz in the high-band 604. In another embodiment, the wideband dual-arm antenna 400 can be configured to operate over the entire frequency range as a high-band and another antenna can be configured to operate in a second frequency range in a mid-band. The efficiency of the antenna can be tuned for specified target bands. The efficiency of the wideband dual-arm antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands.

Figure 7:
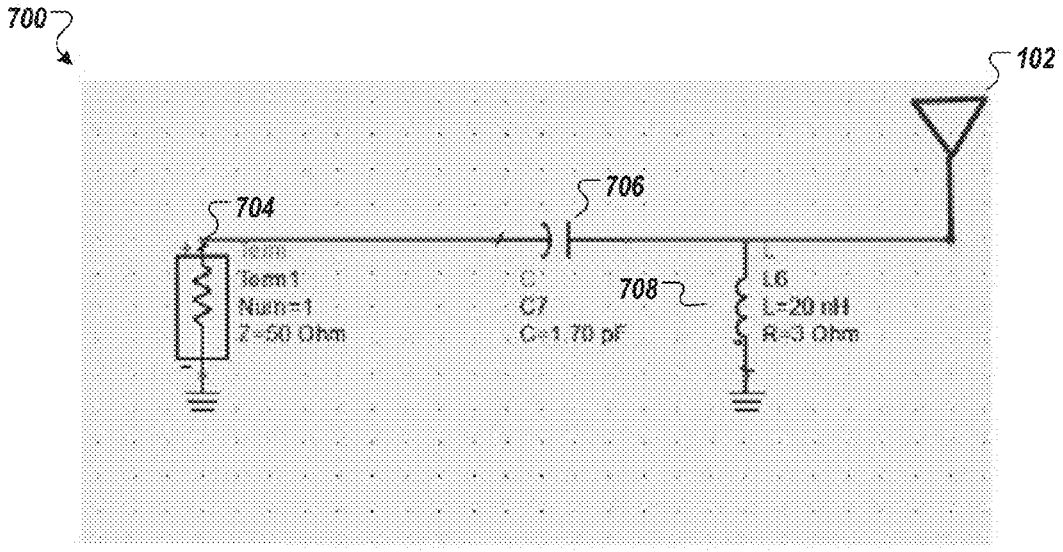
FIG. 7 is an equivalent circuit diagram of an impedance matching network for the first antenna according to one embodiment.

FIG. 7 is an equivalent circuit diagram of an impedance matching network 700 for the first antenna 102 (wideband dual-arm antenna 400) according to one embodiment. The impedance matching network 700 includes a capacitor 705 (e.g., 1.7 pF) coupled in series between the RF feed 704 and the first antenna 102. The impedance matching network 700 also includes an inductor 708 (e.g., 20 nH) coupled in parallel between the first antenna 102 and ground (ground plane). The impedance matching network 7000 may be used for matching impedances for operating the antenna structure in both the high-band (HB) and the mid-band (MB) as described above.

Primary Antenna: Antenna 2 Low-Band Tx/Rx

Figure 8:
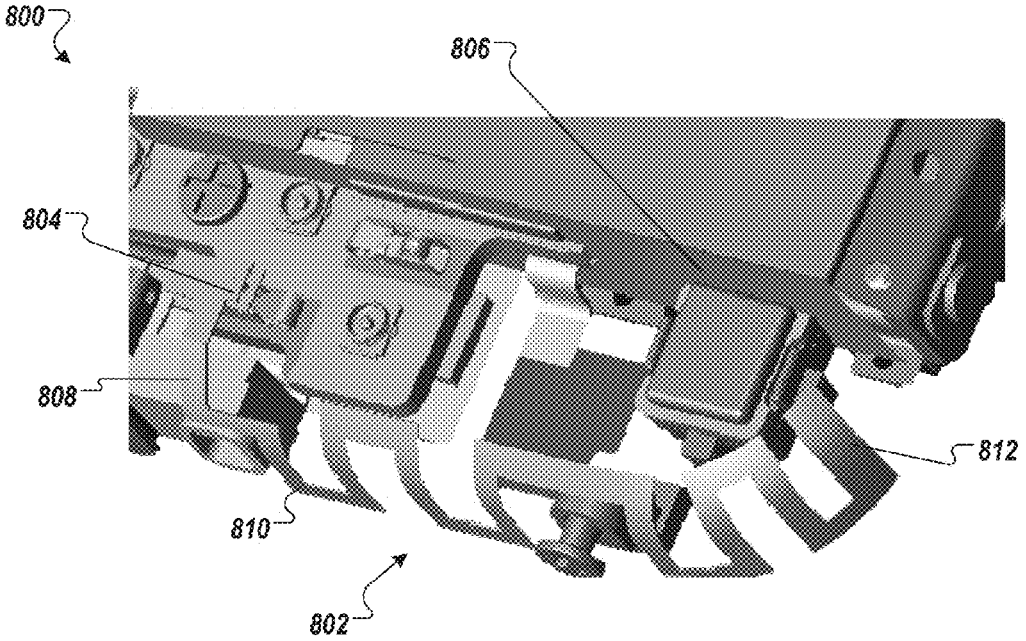
FIG. 8 is a perspective view of a low-band primary antenna structure for a low-band primary antenna according to one embodiment.

As described above, the primary antenna is split into two separate antenna elements with separate RF feeds, one for MB and HB and another for LB. The first antenna 102 is described above with respect to FIGS. 4-7 for MB and HB. The second antenna 10 is described below with respect to FIGS. 8-13 for LB. The second antenna 104 is considered a low-band secondary RX antenna. The second antenna 104 includes an element fed along a bottom edge of the user device, as illustrated in FIG. 8. As described herein, the second antenna element 104 serves as the primary low-band antenna providing coverage for 3GPP bands 17, 29, 20, 5 and 8. These frequency bands range from 704 MHz to 960 MHz which implies that an antenna that covers these frequency bands should have a 30% bandwidth at the center frequency of 832 MHz.

The SAR and HAC for the specific bands are shown in the following table. The SAR on left cheek is higher than on right cheek except Band 4 with net input power 250 mW. HAC is M4 rating for LTE and UMTS bands with net input power of 250 mW but M3 rating for DCS 1800 and PCS 1900 bands with net input power of 1 W.

| Band | SAR (right cheek) | SAR (left cheek) | HAC |
|---|---|---|---|
| 1 | SAR(1 g) = 0.47 (HR) | SAR(1 g) = 0.64 (HL) | M4 |
| 2 | SAR(1 g) = 0.57 (HR) | SAR(1 g) = 0.77 (HL) | M4 (M3 for PCS1900) |
| 3 | SAR(1 g) = 0.59 (HR) | SAR(1 g) = 0.64 (HL) | M4 (M3 for DCS1800 |
| 4 | SAR(1 g) = 0.59 (HR) | SAR(1 g) = 0.56 (HL) | M4 |
| 7 | SAR(1 g) = 0.487 (HR) | SAR(1 g) = 1.02 (HL) | M4 |
| WCS | SAR(1 g) = 0.45 (HR) | SAR(1 g) = 0.83 (HL) | M4 |

In some embodiments, grounding may impact antenna performance. There may be locations that affect efficiency at 1.8 to 2 GHz or the B7 resonance is shifted lower and radiation energy is absorbed at t2.6 GHz. In one embodiment, a home key flex grounding point a ground seal from the back cover metal inlay to the metal chassis can be well grounded to not impact antenna performance.

FIG. 8 is a perspective view of a low-band primary antenna structure 800 according to one embodiment. The low-band primary antenna structure 800 is located at the bottom side of the user device, as illustrated in FIG. 2, and extends from approximately the center of the user device to a bottom right corner of the user device (when looking at the user device from the rear). The low-band primary antenna structure 800 includes a monopole element 802 to cover the low-band (LB) bandwidth (e.g., 704 MHz to 960 MHz). The monopole element 802 is designed to maximize the length of the monopole in the available space and then to match the antenna at the bands of interest to provide good performance. The length of the monopole element 802 is maximized by using a meandered pattern of a conductive trace 806. The conductive trace 806 is coupled to a RF feed point at a proximal end 804 and extends in a first direction towards a bottom edge of the user device to a first fold. From the first fold, the conductive trace 806 extends towards a right side of the user device until a second fold, and from the second fold, the conductive trace 806 extends along the bottom edge until a third fold 810. From the third fold 810, the conductive trace 806 extends toward the right side of the user device, jogging back and forth along the bottom edge of the user device, such as a square-wave pattern until a distal end 812. The meandered pattern can be disposed on an outside face of an LDS insert. The antenna trace can be routed so as to minimize coupling of the antenna traces to components co-located with the antenna (e.g., corner camera, infrared (IR) light emitting diode (LED)). It should be noted that the monopole element 802 is disposed below a ground plane (such as the metal chassis of the user device). The repeating pattern can be used to accommodate other components, such as speakers, microphones, ports or plugs, or the like, such as illustrated in FIG. 8.

The low-band primary antenna structure 800 may be tunable antenna, which employs a reconfigurable matching network based on an antenna tuner (not illustrated in FIG. 8). The monopole element 802 is amendable to tuning to different frequency bands. It should be noted that a static matching network may not provide sufficient bandwidth to cover all the bands of interest. The antenna tuner can be programmed such that a good match is achieved for a narrow bandwidth. The tuner 'state' can be changed depending on the band, channel and wireless technology in use so that the monopole element 802 is well matched for that condition. The monopole element 802 achieves good radiation efficiency and the tunable tuner can be used to realize a matching network that minimizes mismatch and heat loss.

Figure 9:
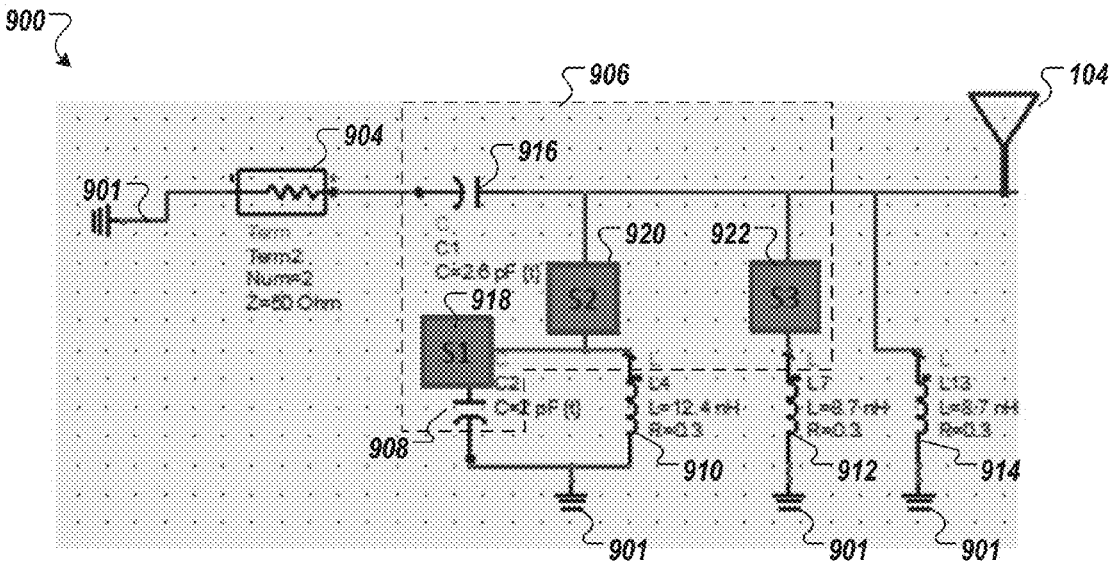
FIG. 9 is an equivalent circuit diagram of an impedance matching network for the second antenna according to one embodiment.

The S11 parameter response of the second antenna 104 lies in the capacitive region between 700 MHz and 960 MHz. The return loss magnitude of the antenna element indicates a match at the desired frequency region, but maybe too shallow in magnitude. The antenna radiation efficiency indicates that the structure is a sufficiently-efficient radiator and can offer good system efficiency with suitable matching. Based on the antenna S11 response, a matching topology with a shunt inductor (L) and series capacitance (C) is found to provide a good match. Since the second antenna 104 is being used for various frequency bands within the covered frequency range, an antenna tuner can be used to provide different matching for the different frequency bands, such as illustrated in FIG. 9. Alternatively, other matching topologies may be used.

FIG. 9 is an equivalent circuit diagram of an impedance matching network 900 for the second antenna 104 according to one embodiment. The impedance matching network 900 includes an antenna tuner 906 coupled between a RF feed 904 and the second antenna 104. The antenna tuner 906 includes a series capacitance 916 coupled between an input node 903 and an output node 905. The antenna tuner 906 also includes three switches S1 918, S2 920, and S3 922. A first shunt inductor 914 is coupled in parallel between the output node 905 and ground 901. The third switch S3 922 can be activated to selectively couple a second shunt inductor 912 in parallel between the output node 905 and ground 901. The second switch S2 920 can be activated to selectively couple a third shunt inductor 910 in parallel between the output node 905 and ground 901. The first switch S1 918 can be activated to selectively couple a shunt capacitor 908 in parallel to the third shunt inductor 910 and ground 901. The shunt capacitor 908 may also be part of the antenna tuner 906.

In one embodiment, the antenna tuner 906 is the QFE1520 antenna tuner, developed by Qualcomm Inc. of San Diego Calif. As illustrated in FIG. 9, the tuner block diagram indicates the available variable series capacitor C1 916 and shunt capacitor C2 908 with tunable ranges from 0.8-8 pF (64 steps) and 0.6-2 pF (16 steps) respectively. Three single pull single throw switches 918, 920, 922 are also integrated on the same die. The QFE1520 antenna tuner also provides an integrated power detector and directional coupler. The antenna tuner settings can be controlled via: a) Open Loop control: Utilizes a look up table that can be programmed to present certain tuning states and switch configuration corresponding to the wireless technology and band of operation; b) Advanced Open Loop control: Utilizes data available from the sensors including the on-board power detector and coupler to pick up appropriate tuner parameters based on pre-programmed look-up tables corresponding to each sensor input; or c) Closed Loop: True adaptive tuning provided by real time adjustment of tuner parameters based on the sensor inputs. Alternatively, the antenna tuners than the QFE1520 antenna tuner may be used.

Figure 10:
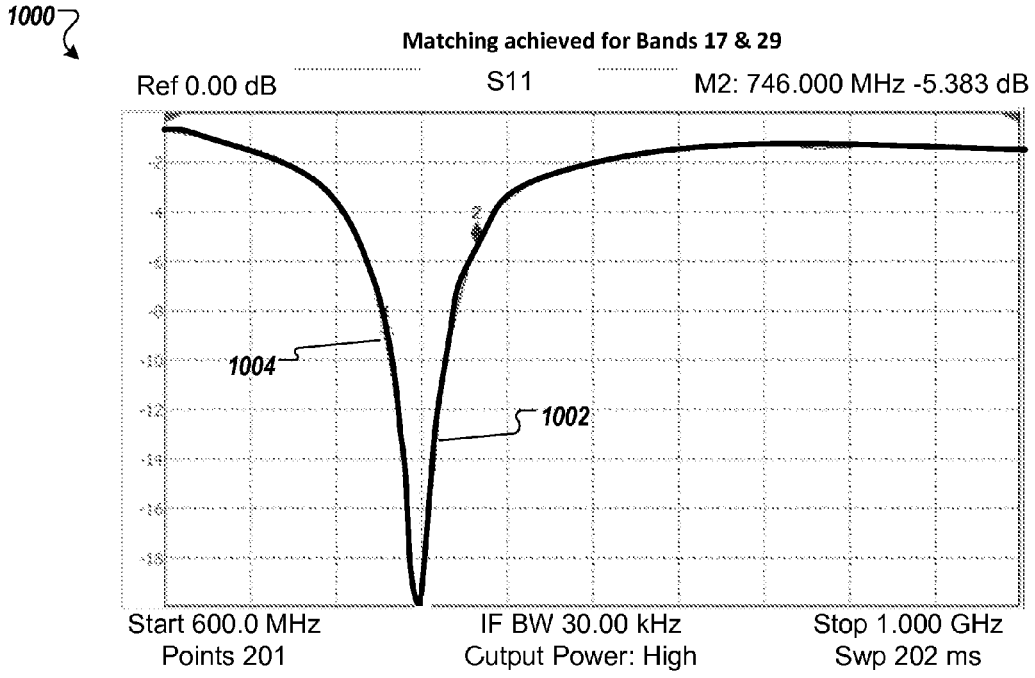
FIG. 10 is a graph of return loss of the low-band primary antenna structure of FIG. 8 with impedance matching for a first set of frequency bands according to one embodiment.
Figure 11:
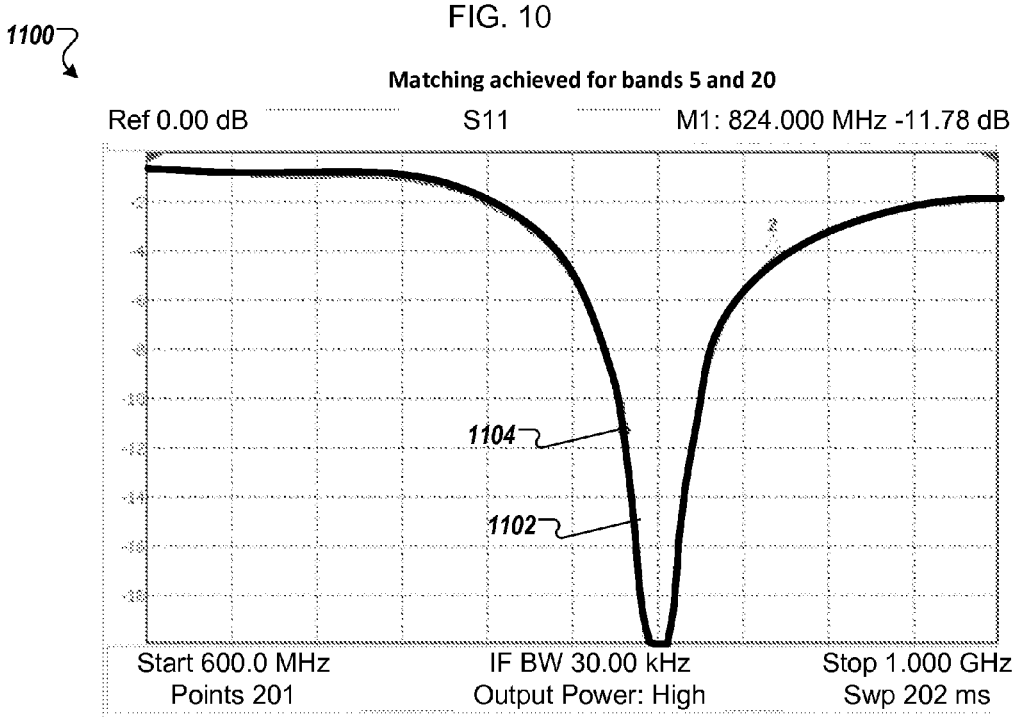
FIG. 11 is a graph of return loss of the low-band primary antenna structure of FIG. 8 with impedance matching for a second set of frequency bands according to one embodiment.
Figure 12:
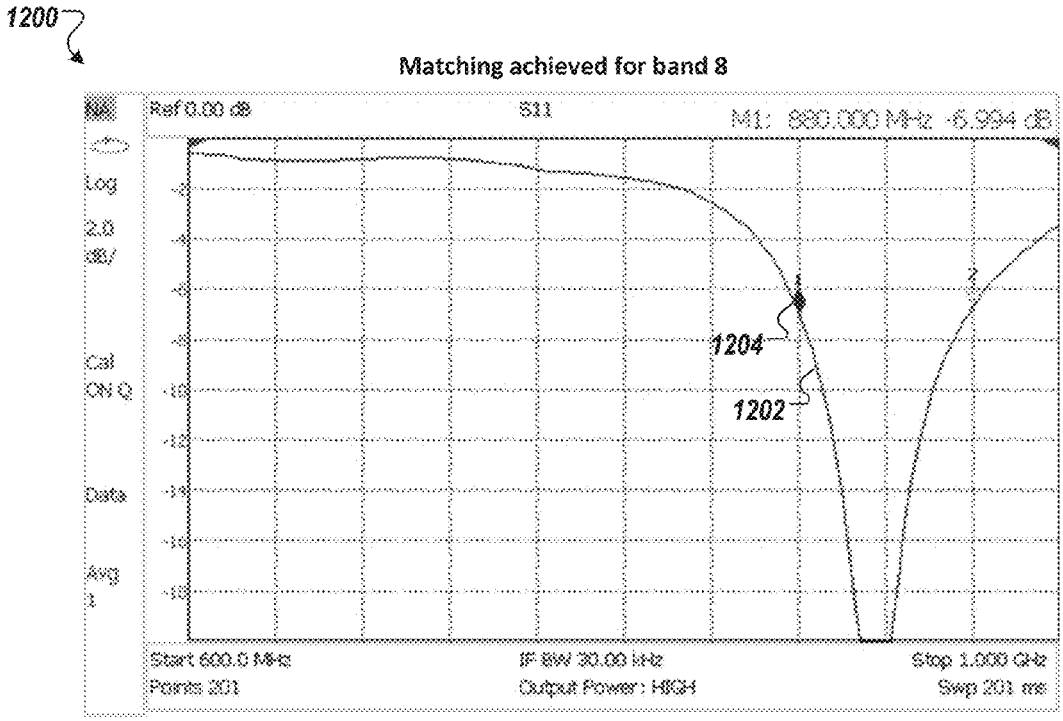
FIG. 12 is a graph of return loss of the low-band primary antenna structure of FIG. 8 with impedance matching for a third set of frequency bands according to one embodiment.

In one embodiment, when open loop control is used, based on the S11 response of the low-band primary antenna structure 800, a shunt L and series C matching network topology is suitable and the antenna tuner 906 can switch in and out the appropriate inductors from the impedance matching network 900. The values of the shunt inductors 910, 912, 914 are selected in such a way that the shunt inductor 914 (L13) in conjunction with the variable series capacitance 916 (C1) provides a good match for Band 17. Then inductor value for shunt inductor 910 (L4) is chosen such that inductors 914 (L13) and 910 (L4) in parallel provide an effective inductance which in conjunction with the variable series capacitor 916 (C1) provides a good match for Band 5. Extending this approach, the shunt inductor 912 (L7) is selected such that the inductance offered with shunt inductor 912 (L7) and shunt inductor 914 (L13) in parallel in conjunction with the variable series capacitor 916 (C1) provides a good match for Band 8. The match for Band 20 may be achieved by utilizing the available shunt variable capacitor 908 (C2) to form a tank circuit with shunt inductor 910 (L4) and connected in series to the variable series capacitor 916 (C1). The return losses for these bands are illustrated in FIGS. 10-12.

The following table shows an example of a state table for the antenna tuner 906 for tuning to the various bands. Alternatively, other state tables may be used for other tuners and other matching network configurations.

| Bands | Channels | C1 Tuning State (series) | C2 tuning state (Shunt) | SW-1 | SW-2 | SW-3 |
|---|---|---|---|---|---|---|
| 17 | L, M | 5 | — | 0 | 0 | 0 |
| 17 | H | 3 | — | 0 | 0 | 0 |
| 20 | L, M | 10 | 2.9 | 1 | 1 | 0 |

-continued

| Bands | Channels | C1 Tuning State (series) | C2 tuning state (Shunt) | SW-1 | SW-2 | SW-3 |
|---|---|---|---|---|---|---|
| 20 | H | 4 | 0 | 0 | 1 | 0 |
| 5 | L, M | 13.5 | 8 | 0 | 1 | 0 |
| 5 | H | 16 | 0 | 1 | 0 | 1 |
| 8 | L, M, H | 16 | 8 | 0 | 0 | 1 |
| 29 | L, M, H | 3 | — | 0 | 0 | 0 |

As shown in the table above, three states may be used to cover the various bands and one state may use different values for C1, C2 or both to tune to different bands within the same state.

FIG. 10 is a graph 1000 of return loss of the low-band primary antenna structure 800 of FIG. 8 with impedance matching for a first set of frequency bands according to one embodiment. The graph 1000 shows the return loss 1001 of the low-band primary antenna structure 800 with antenna tuner 906 tuned for Band 17 and Band 29 in the low-band (LB). The graph 1000 illustrates that the low-band primary antenna structure 800 can be caused to radiate electromagnetic energy between approximately 700 MHz to 960 MHz, but can be specifically tuned to have a sharp resonance for Band 17 and Band 29. For example, the return loss 1002 at 746 MHz is −5.383 dB, labeled as point 1004. As described herein, the resonant LB mode may cover different frequency ranges and may be centered at different frequencies than those described and illustrated herein.

FIG. 11 is a graph 1100 of return loss of the low-band primary antenna structure of FIG. 8 with impedance matching for a second set of frequency bands according to one embodiment. The graph 1100 shows the return loss 1101 of the low-band primary antenna structure 800 with antenna tuner 906 tuned for Band 5 and Band 20 in the low-band (LB). The graph 1100 illustrates that the low-band primary antenna structure 800 can be caused to radiate electromagnetic energy between approximately 700 MHz to 960 MHz, but can be specifically tuned to have a sharp resonance for Band 5 and Band 20. For example, the return loss 1102 at 824 MHz is −11.78 dB, labeled as point 1104.

FIG. 12 is a graph 1200 of return loss of the low-band primary antenna structure of FIG. 8 with impedance matching for a third set of frequency bands according to one embodiment. The graph 1200 shows the return loss 1201 of the low-band primary antenna structure 800 with antenna tuner 906 tuned for Band 8 in the low-band (LB). The graph 1200 illustrates that the low-band primary antenna structure 800 can be caused to radiate electromagnetic energy between approximately 700 MHz to 960 MHz, but can be specifically tuned to have a sharp resonance for Band 8. For example, the return loss 1202 at 880 MHz is −6.994 dB, labeled as point 1204.

In these embodiments, the second antenna 104 can achieve return loss with the antenna tuner 906 being configured into three tuning states (illustrated in the three different graphs), to cover the low-bands, e.g., Bands 17, 29, 20, 5 & 8. The shift in the sharp resonances illustrated in the graphs are due to the impedance matching networks achieved by the antenna tuner 906, since the S11 response of the monopole element 802 by itself may be more flat and shallow over a wide frequency range of 700 MHz to 960 MHz.

Figure 13:
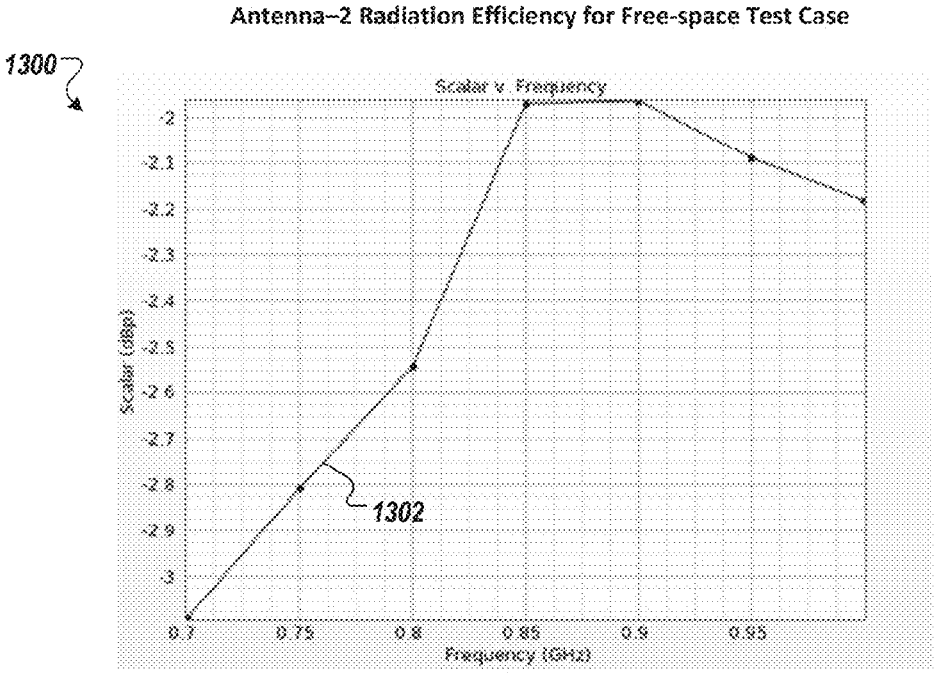
FIG. 13 is a graph of measured efficiency of the low-band primary antenna structure of FIG. 8 according to one embodiment.

FIG. 13 is a graph 1300 of measured efficiency of the low-band primary antenna structure 800 of FIG. 8 according to one embodiment. The graph 1300 illustrates the total efficiency 1301 over a frequency range in the low-band (LB) for Free-space. The total efficiency 1301 of the antenna can be measured by including the loss of the structure (e.g., due to mismatch loss), dielectric loss, and radiation loss. The graph 1300 illustrates that the low-band primary antenna structure 800 is a viable antenna for LB frequency ranges. The efficiency of the antenna can be tuned for specified target bands, such as bands 17, 29, 20, 5 & 8. The efficiency of the low-band primary antenna structure 800 may be modified by the antenna tuner 906, as well as by adjusting dimensions of the 3D structure, the gaps between the elements of the antenna structure, or any combination thereof. Similarly, 2D structures can be modified in dimensions and gaps between elements to improve the efficiency in certain frequency bands. The series capacitor in the antenna tuner 906 and switch configurations are altered to achieve three different states thus covering the entire WAN low bands with good matching.

Figure 14:
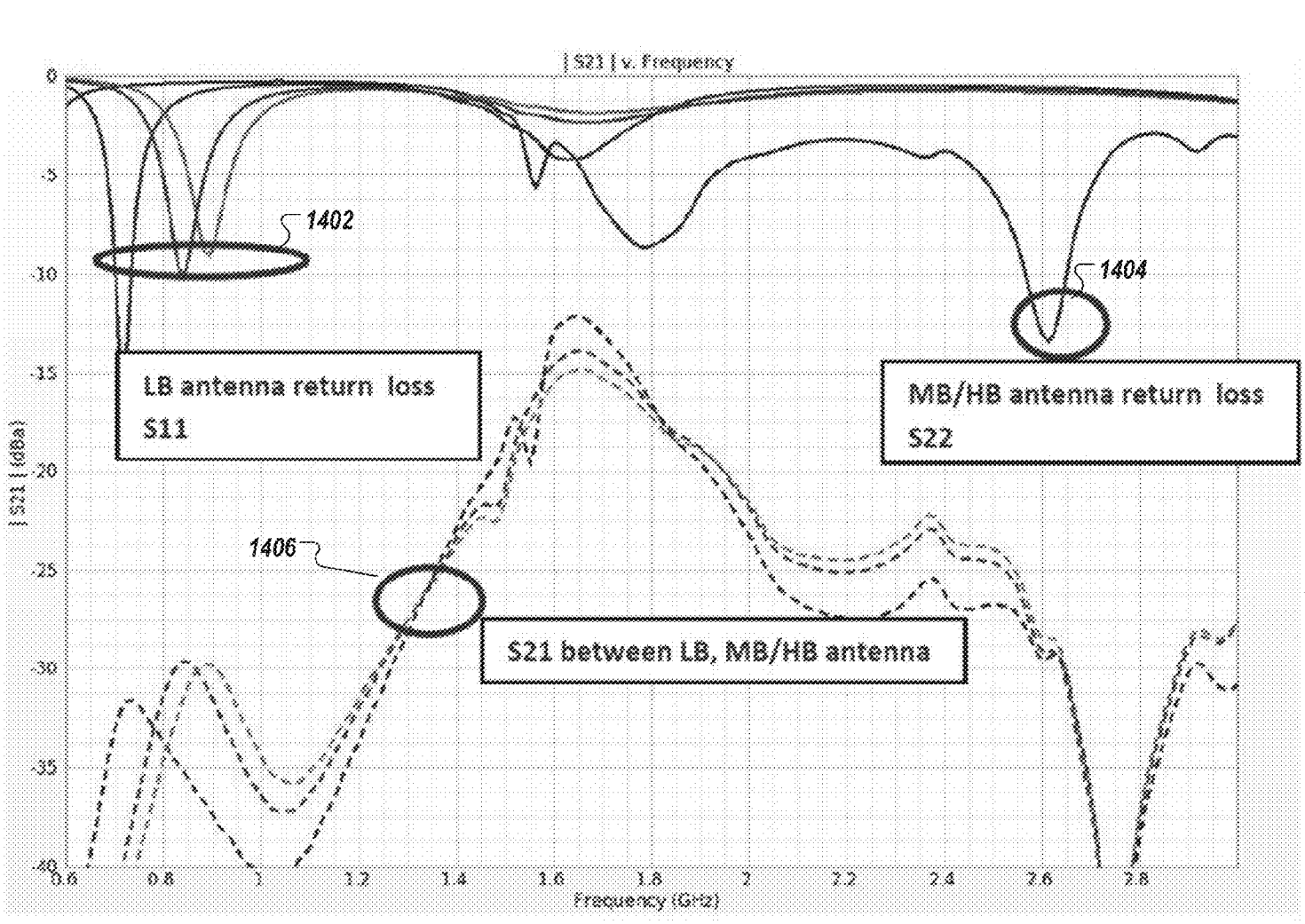
FIG. 14 is a graph illustrating isolation between the first antenna and second antenna with different antenna matching in the low-band (LB) according to one embodiment.

FIG. 14 is a graph 1400 illustrating isolation between the first antenna and second antenna with different antenna matching in the low-band (LB) according to one embodiment. When tuning the LB antenna impedance of the second antenna 104, the isolation between the LB antenna (second antenna 104) and the MB/HB antenna (first antenna 102) also changes. FIG. 14 shows the LB antenna return loss S11 1402, the MB/HB antenna return loss S22 1404 and the isolation 1406. The isolation is well above 12 dB over the frequency range, even when tuning the LB antenna. Similar, there is almost no impact on the efficiency of MB/HB antenna when tuning the LB antenna.

In another embodiment, the main antenna may be a tri-feed antenna architecture; one feed for LB (bands 17, 20, 29, 5, 8, GSM 860, EGSM 900); one feed for MB (bands 1, 2, 3, 4, DCS, PCS); and one feed for HB (Band 7 and WCS). The LB antenna may need larger spaces because of the nature of the longer wavelength. The dual-feed antenna architecture of FIG. 4 moves the HB antenna to the MB antenna side and combines the bandwidth of the MB and HB in one antenna. This dual-feed antenna architecture may be that the LB antenna has more clearance for radiation and more board area to put the los loss lumped elements for matching. Another benefit may be that the carrier aggregation (CA) between LA and HB is possible with this solution. This architecture may have a 1 GHz bandwidth requirement (from 1.71-2.69 GHz) and high efficiency requirements on these bands. The design of the MB/HB antenna uses a dual-arm monopole antenna coupled with a ground parasitic. The ground parasitic covers the highest frequency radiation (e.g., 2.69 GHz) and helps the matching of the lower frequency (e.g., 1.71 GHz). The dual-arm structure covers the lowest frequency radiation (e.g., 1.7 GHz) and expands the bandwidth in between the lowest and highest frequencies. FIG. 4 shows the compactness of the antenna space. The LB antenna is a meandered monopole (illustrated in FIG. 8) and the MB/HB antenna is a dual arm antenna with parasitic ground element (illustrated in FIG. 4). The antennas may be fed near the USB port to reduce noise pickup when the USB port is active.

The following description is directed to the secondary antenna (third and fourth antennas) and auxiliary antennas (fifth antenna, etc.).

Secondary Antenna: Antenna 5 Low-Band Rx

Figure 15:
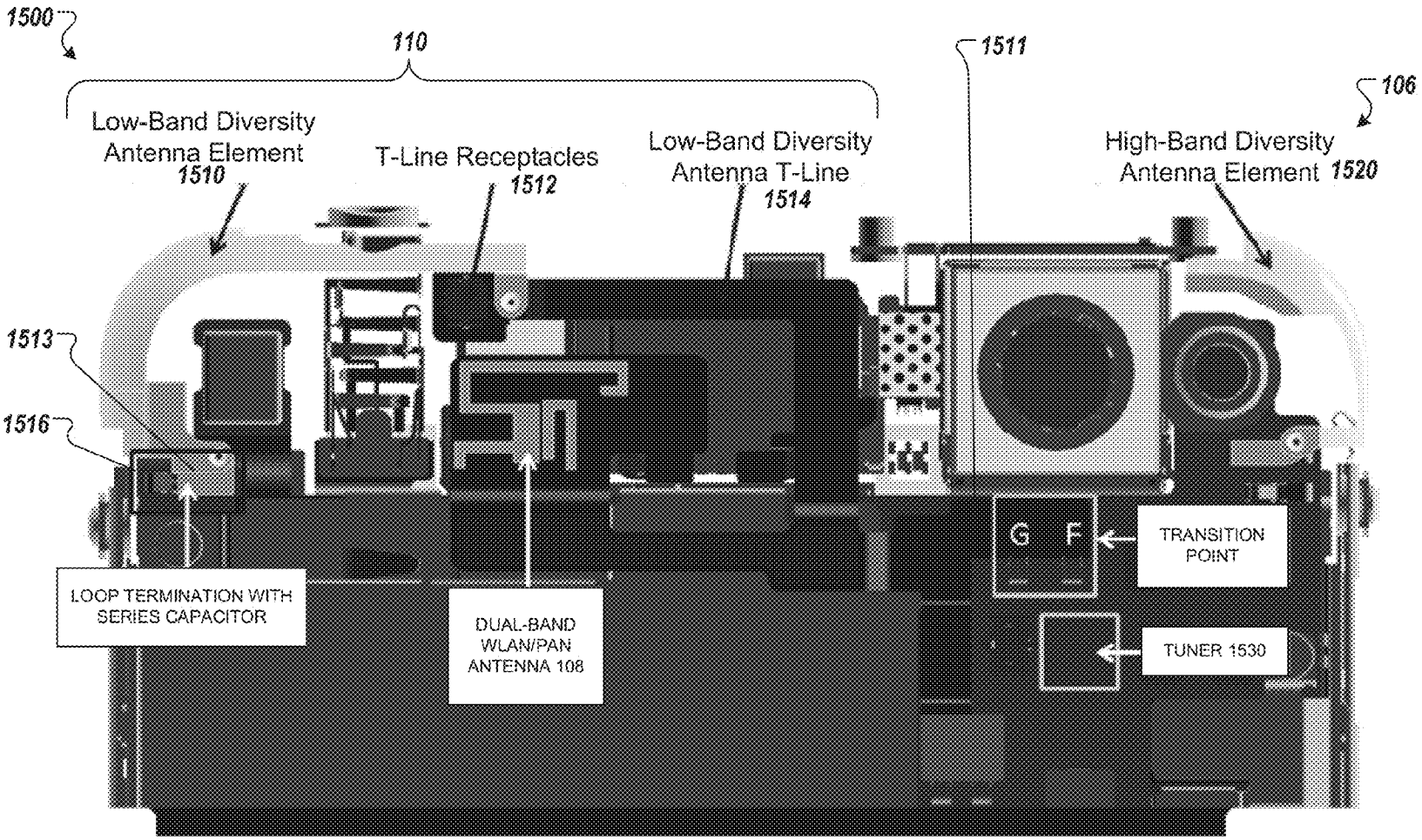
FIG. 15 is a rear view of a secondary antenna with a low-band diversity antenna and a high-band diversity antenna, and a dual-band WLAN/PAN antenna at a top side of the user device according to one embodiment.

FIG. 15 is a rear view of a secondary antenna 1500 with a low-band diversity antenna and a high-band diversity antenna, and a dual-band WLAN/PAN antenna at a top side of the user device according to one embodiment. The third antenna 106 is the high-band diversity antenna and the fifth antenna 110 is the low-band diversity antenna. The third antenna 106 can also operate as an integrated secondary high-band RX/GPS antenna for MIMO and Diversity, as described herein. The fourth antenna 110 includes a low-band diversity antenna element 1510, T-line receptacles 1512, and low-band diversity antenna T-line 1514. The low-band diversity antenna T-line 1514 is coupled to RF feed at a proximal end 1511. The low-band diversity antenna T-line 1514 is coupled to the low-band diversity antenna element 1510 by way of T-line receptacles 1512. The low-band diversity antenna element 1510 is coupled to the ground plane with a ground termination capacitor 1516 (CE) at a distal end 1513. A semi-rigid coax cable may be connected to a spring contact right after the antenna tuner 1530 and exited orthogonal to a back surface of the user device in order to remain identical to the low-band main antenna fixture so that accurate ECC can be measured. In other embodiments, the antenna tuner 1530 may not be used. The low-band diversity antenna element 1510 is terminated to the ground through a ground termination capacitor 1516 as indicated in FIG. 15. The ground termination capacitor 1516 helps the low-band diversity antenna operate in a loop mode or a monopole mode and plays a critical role to control ECC. The ground termination capacitor 1516 may be 1.5 pF to result in an acceptable ECC, which is below 0.5, and acceptable radiation efficiency.

Figure 18:
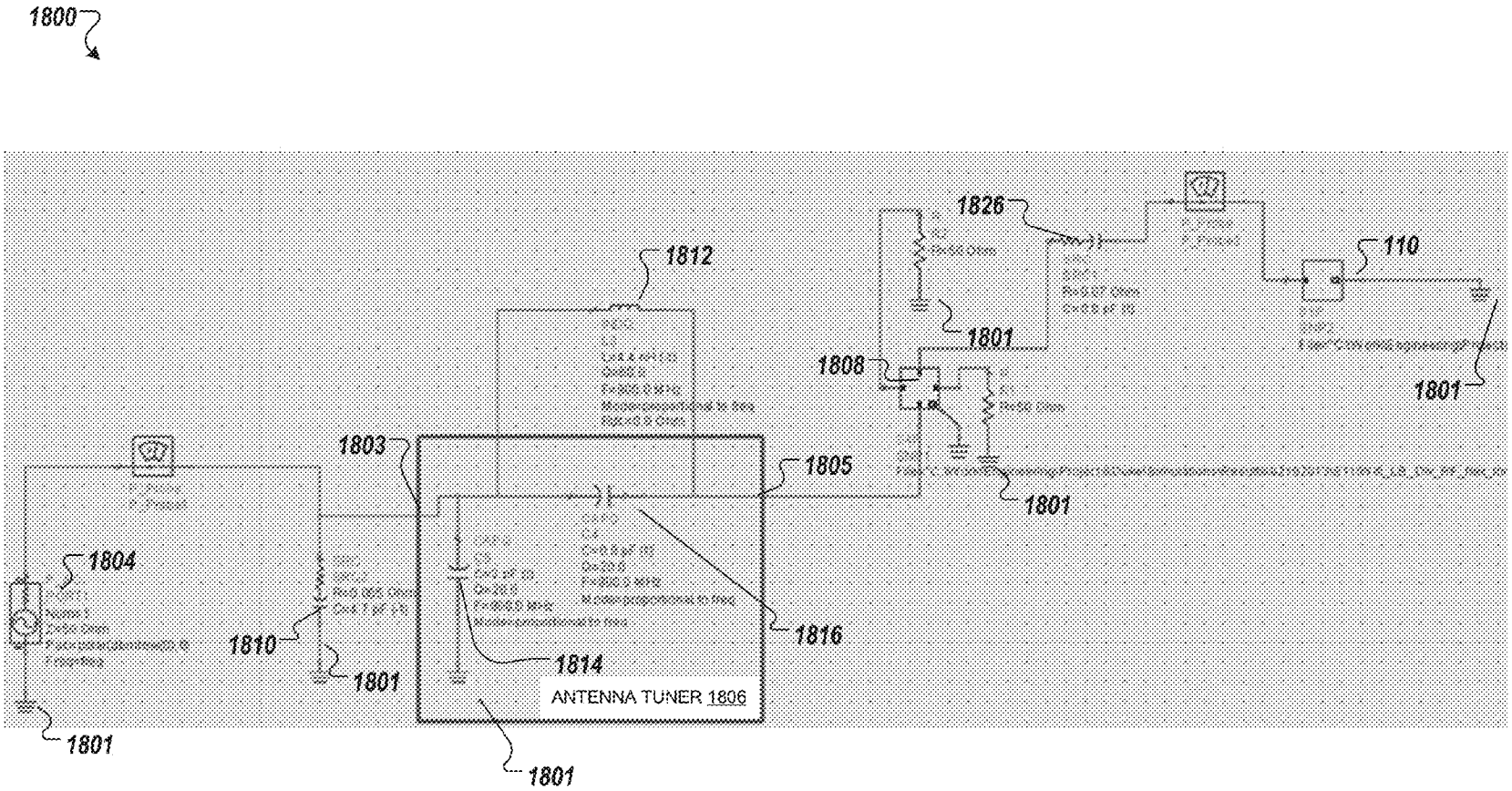
FIG. 18 is an equivalent circuit diagram of an impedance matching network for the fifth antenna according to one embodiment.

In one embodiment, in order to improve radiation efficiency, a pre-matching component is placed at the junction (T-receptacles 1512) between the low-band diversity antenna element 1510 (e.g., LDS part) and the 50-ohm transition line 1514 (e.g., distal end of the flex part). Pre-matching of the fifth antenna 110 may be used to improve the impedance transition from the antenna element to 50-ohm transmission line, such as illustrated in FIGS. 18.

Figure 16:
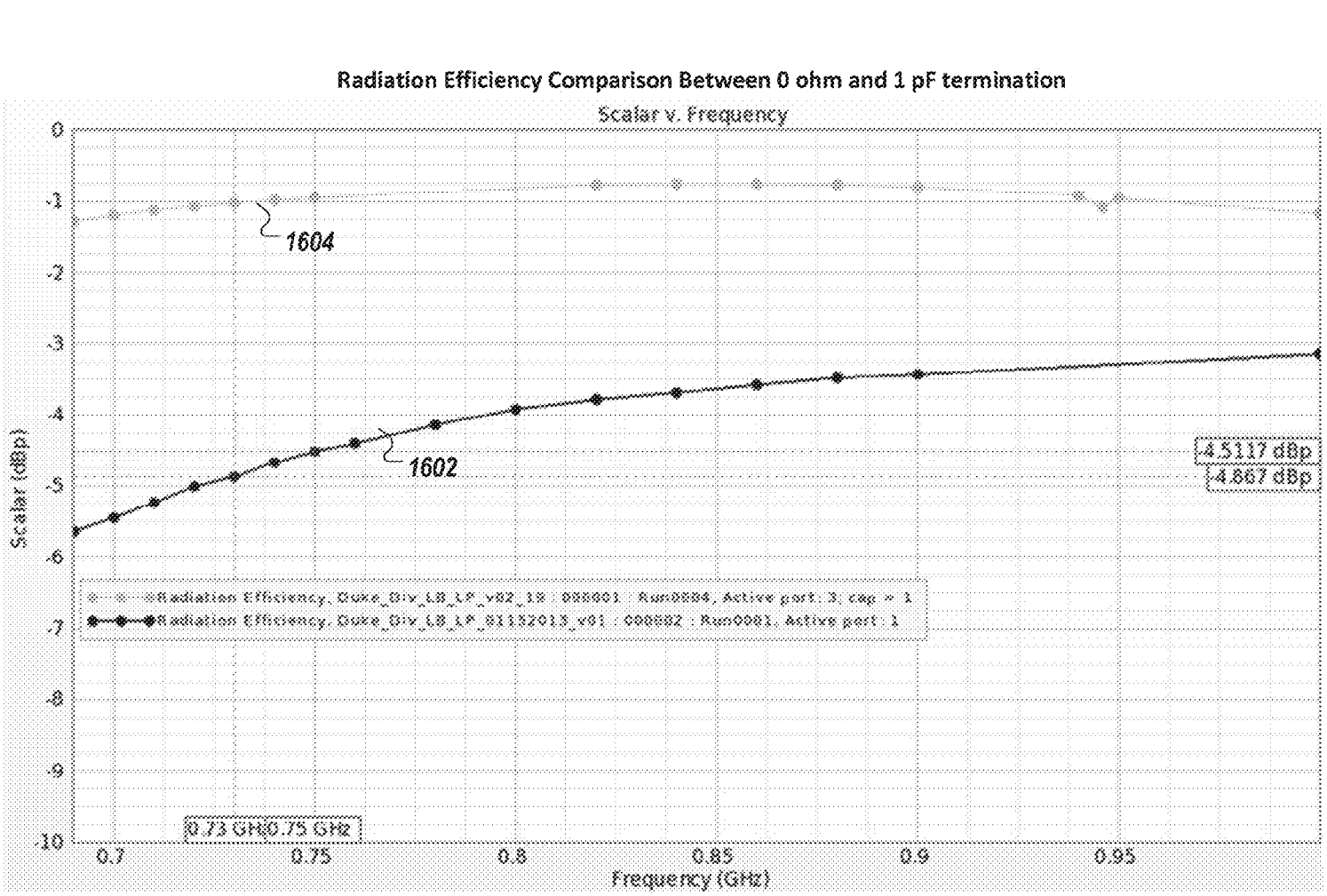
FIG. 16 is a graph of radiation efficiency comparison between 0-ohm and 1 pF termination according to one embodiment.

In one exemplary embodiment, the low-band diversity antenna element 1510 is a printed through LDS process. The one end is connected to the T-line receptacles 1512 that feeds the low-band diversity antenna element 1510 from the low-band diversity antenna T-line 1514. A capacitor (not illustrated) (e.g., 1.5 pF capacitor) is placed between the low-band diversity antenna element 1510 and the T-line receptacles 1512. The other distal end 1513 is connected to the PCB ground through the ground termination capacitor 1516 (e.g., 2.5 pF capacitor) for loop termination. The ground termination capacitor 1516 that connects the low-band diversity antenna element 1510 to the ground. As shown in FIG. 16, there is a significant difference in radiation efficiency between the antenna grounded to the PCB through 0 ohm resistor and that through 1 pF capacitor. FIG. 16 is a graph 1600 of radiation efficiency comparison between 0-ohm termination 1602 and 1 pF termination 1604 according to one embodiment.

In one embodiment, the T-line receptacles 1512 can be replaced with a spring contact on the flex to improve the reliability. For example, both the spring contact and a pre-matching component may be placed on the flex where the receptacle used to be. The spring contact may be a low profile (e.g., 1.3 to 2 mm tall) with a 1.5 pF pre-matching component placed on the flex. Ground layers underneath the spring contact may be removed so that there is no parasitic capacitance.

The low-band secondary diversity antenna 110 can be used to cover LTE Band 29, 17, 19, 20, 5 and 8. The low-band secondary diversity antenna is placed on the top left corner of the device. In one embodiment, the low-band diversity antenna element 1510 is printed on LDS and is fed through a 50-ohm transmission line designed to be connected to an antenna tuner 1530 disposed on the PCB. The antenna tuner 1530 may be the QFE1550 antenna tuner, developed by Qualcomm, Inc. of Sand Diego. Alternatively, other antenna tuners may be used. On the feed side, the low-band secondary diversity antenna 110 is connected to the receptacle soldered on the LDS part through a 1.5 pF capacitor in series. The distal end 1513 is connected to the PCB ground through 2.5 pF capacitor creating a loop structure. The antenna tuner 1530 is used to tune the antenna resonance. The antenna tuner1530 may include one variable capacitor in series, one variable capacitor in shunt and two switches. Two extra components, one inductor and one capacitor, are connected to the variable series capacitor and shunt capacitor, respectively in order to provide better tuning range. The following table is an example matrix used to tune the resonance frequency of the low-band secondary diversity antenna 110. Each tuner state shown in the table is used to determine the resonant frequency of the low-band secondary diversity antenna 110 and results in system efficiency that is appropriate for the band desired.

| | Tuner Selection | | Tuner Stage | | |
|---|---|---|---|---|---|
| Ch | Tuner 1 | Tuner 2 | L | M | H |
| B29 | 1 | 0 | 12, 63 | 12, 63 | 12, 63 |
| B17 | 0 | 0 | 12, 63 | 12, 37 | 12, 20 |
| B5 | 1 | 1 | 12, 25 | 12, 22 | 12, 16 |
| B8 | 1 | 1 | 12, 12, | 12, 6 | 12, 0 |
| B20 | 0 | 1 | 0, 46 | 0, 38 | 0, 31 |

The low band diversity antenna 110 is designed so that it can meet both efficiency and ECC requirements specified by carriers in different regions. The performance assessment shows that it can satisfy the requirements on LTE Band 17 and 5 with a margin (e.g., 5.1 dB and 0.7 dB, respectively).

Figure 17:
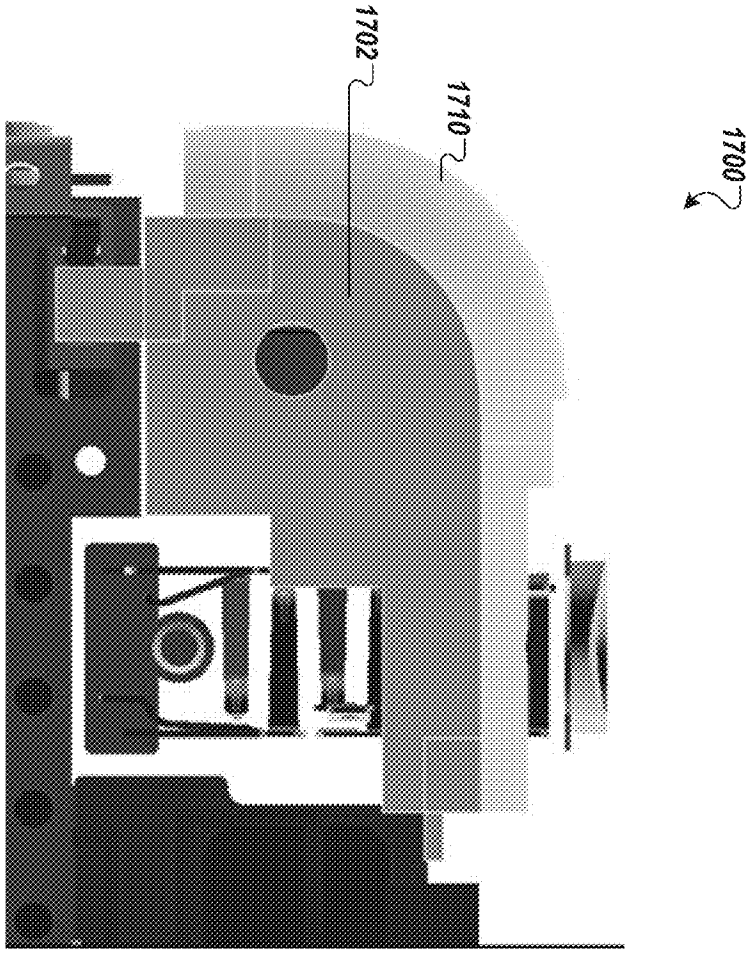
FIG. 17 shows a low-band diversity antenna element that includes a top surface with a flat part according to another embodiment.

Patterns for the antenna element have impact on the radiation efficiency and ECC. One pattern is illustrated in FIG. 15 where the low-band diversity antenna element 1510 does not include a top surface with a flat part. In contrast, FIG. 17 shows a low-band diversity antenna element 1710 that includes a top surface with a flat part 1702 according to another embodiment. In some cases, the flat part 1702 performs better in terms of radiation efficiency and ECC.

In one embodiment, the low band diversity antenna 110 has an L-shape strip for grounding. The L-shape strip may impact the low-band diversity antenna positively when grounded to the device chassis 112, such as grounding to a metal stiffener bracket (e.g., for another component (speaker) and the device chassis (rear housing). Alternatively, the L-shape strip can be grounded between the PCB and a front chassis.

FIG. 18 is an equivalent circuit diagram of an impedance matching network 1800 for the fifth antenna 110 according to one embodiment. The impedance matching network 1800 includes an antenna tuner 18806 coupled between a RF feed 1804 and the fifth antenna 110. The antenna tuner 1806 includes a series capacitance 1816 coupled between an input node 1803 and an output node 1805. The antenna tuner 1806 also includes a shunt capacitor 1814 coupled in parallel between the input node 1803 and ground 1801. A shunt capacitor 1810 is coupled between the input node 1803 and ground 1801 (outside of the antenna tuner 1806). The impedance matching network 1800 also includes an inductor 1812 coupled in parallel to the series capacitor 1816, which is coupled between the input node 1803 and the output node 1805. The shunt capacitor 914 is coupled in parallel between the output node 905 and ground 901. The output node 1805 is coupled to a transmission line receptacle 1808, which is representative of a transmission line. A pre-matching component 1826, such as a pre-matching capacitor, is coupled in series between the transmission line receptacle 1808 and the low-band secondary diversity antenna element. The antenna tuner 1806 can be tunable using the variable capacitors 1804 (e.g., 2 pF) and 1816 (e.g., 0.8 pF). As value of the pre-matching component 1826 changes, the loss of the system varies accordingly. For a demonstration purposes, two values are chosen for the pre-matching, 0 ohm and 1.5 pF. Between 0 ohm and 1.5 pF of pre-matching values, there is approximately 2 dB difference in system loss which is caused by the mismatch at the junction between the antenna and the transmission line. By providing the pre-matching at the junction, excessive loss can be effectively prevented.

Figure 19:
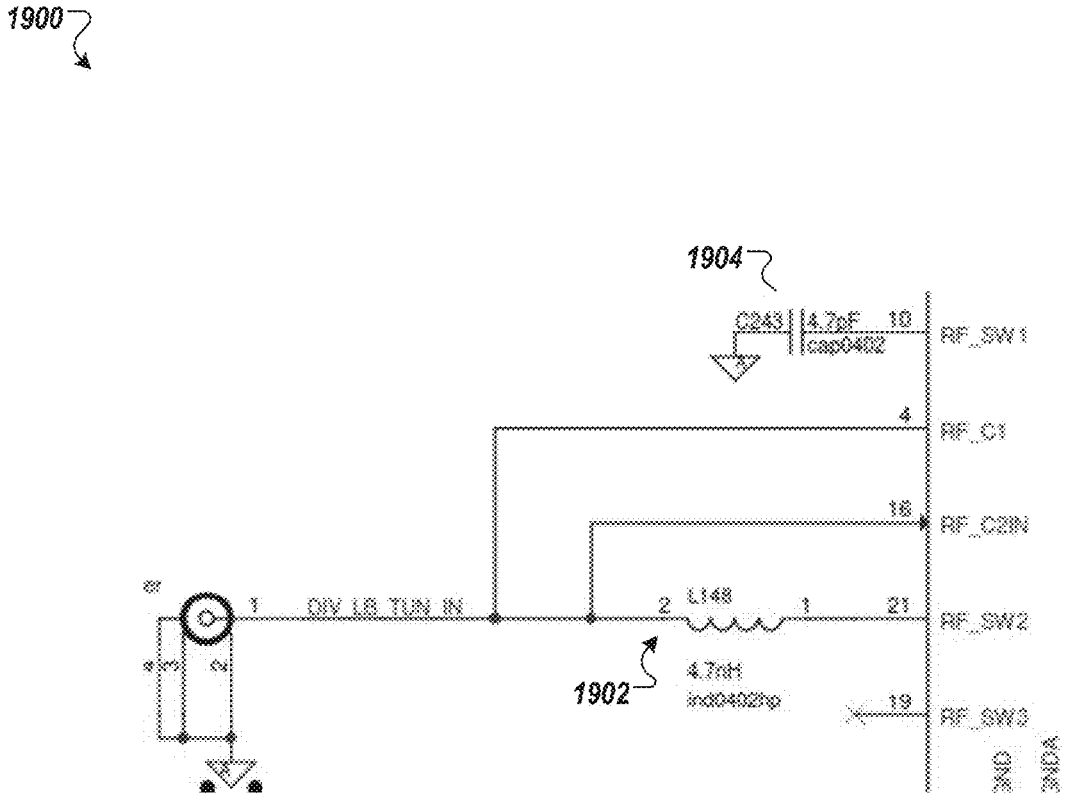
FIG. 19 is an antenna architecture of an antenna tuner according to one embodiment.

In one embodiment, the antenna tuner 1806 is the QFE1550 antenna tuner, developed by Qualcomm Inc. of San Diego Calif. As illustrated in the tuner block diagram of FIG. 19, the QFE1550 antenna tuner is used to provide variable series and shun capacitors along with two other discrete components. For example, an inductor 1902 (e.g., 4.7 nH inductor) is placed between RF_C2In and RF_SW2 in order to provide adequate tuning for LTE B20, B5 and B8 as well as equivalent WCDMA bands. A capacitor 1904 (e.g., 4.4 pF capacitor) is placed at RF_SW1 in order to provide larger value of shunt capacitance.

After the 50-ohm transmission line without a pre-matching component, the impedance presented to the tuner from transmission line moves the impedance by about ¼ λ from the antenna placing the antenna impedance to the tuner near short condition or low resistance (1.2~2.5 Ohms). In a contrary, the impedance transition from the antenna to the tuner through the 50-ohm transmission line with a pre-matching series capacitor (pre-matching component 1826) (e.g., 1.5 pF series capacitor) results in different impedance to the tuner.

Figure 20:
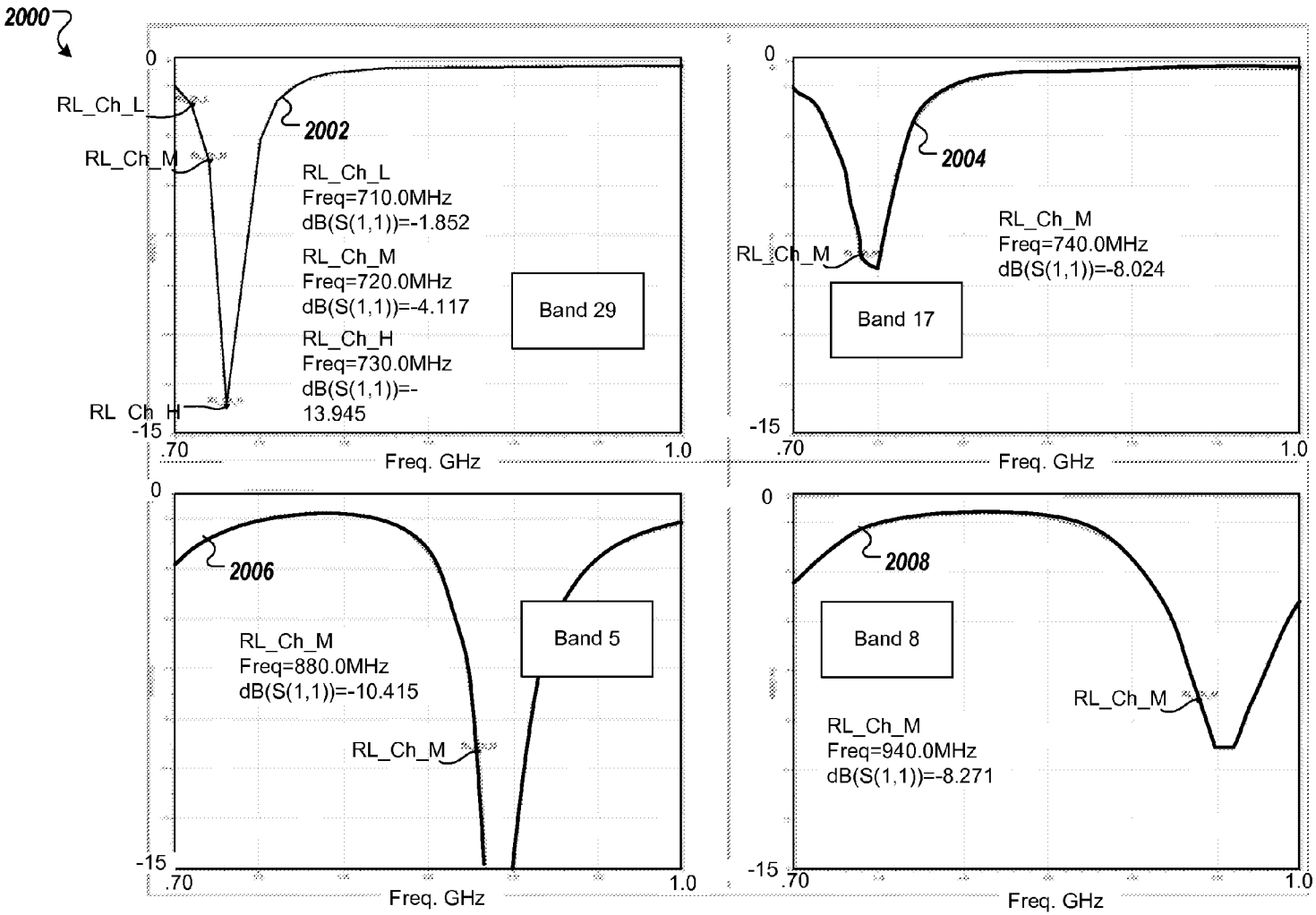
FIG. 20 includes graphs of return losses of the low-band secondary antenna structure of FIG. 15 with impedance matching for a set of frequency bands according to one embodiment.

FIG. 20 includes graphs 2000 of return losses of the low-band secondary antenna structure 110 of FIG. 15 with impedance matching for a set of frequency bands according to one embodiment. The top left graph shows a return loss 2002 where the low-band secondary antenna structure 110 is tuned to Band 29. The top right graph shows a return loss 2004 where the low-band secondary antenna structure 110 is tuned to Band 17. The bottom left graph shows a return loss 2006 where the low-band secondary antenna structure 110 is tuned to Band 5. The bottom right graph shows a return loss 2008 where the low-band secondary antenna structure 110 is tuned to Band 8. As described herein, the resonant LB mode may cover different frequency ranges and may be centered at different frequencies than those described and illustrated herein.

Referring back to FIG. 15, the low-band secondary diversity antenna 110 shares the volume at the top with the fourth antenna 108 and the third antenna 106. The fourth antenna 108 is the dual-band BT/Wi-Fi antenna that is described in more detail with respect to FIGS. 26-30. The third antenna 106 is the integrated high-band diversity/GPS antenna that includes a high-band diversity antenna element 1520. The integrated high-band diversity/GPS antenna is described in more detail with respect to FIGS. 21-25.

Secondary Antenna: Antenna 3 Integrated High-Band RX/GPS

Figure 21B:
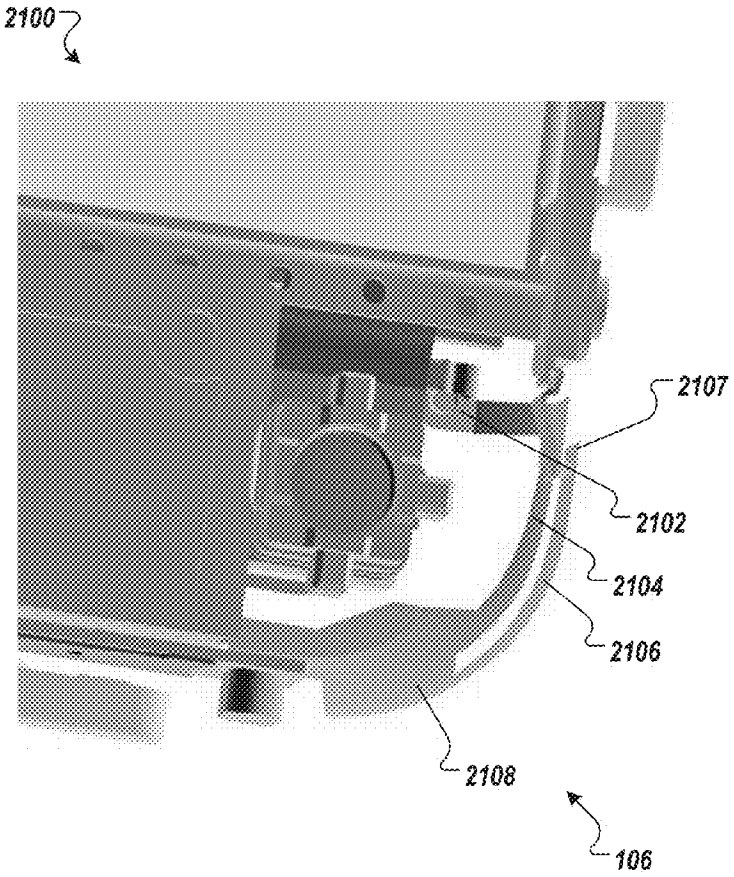
FIGS. 21A-21B are a perspective rear view and a perspective front view of an integrated high high-band diversity/GPS antenna according to one embodiment.
Figure 21A:
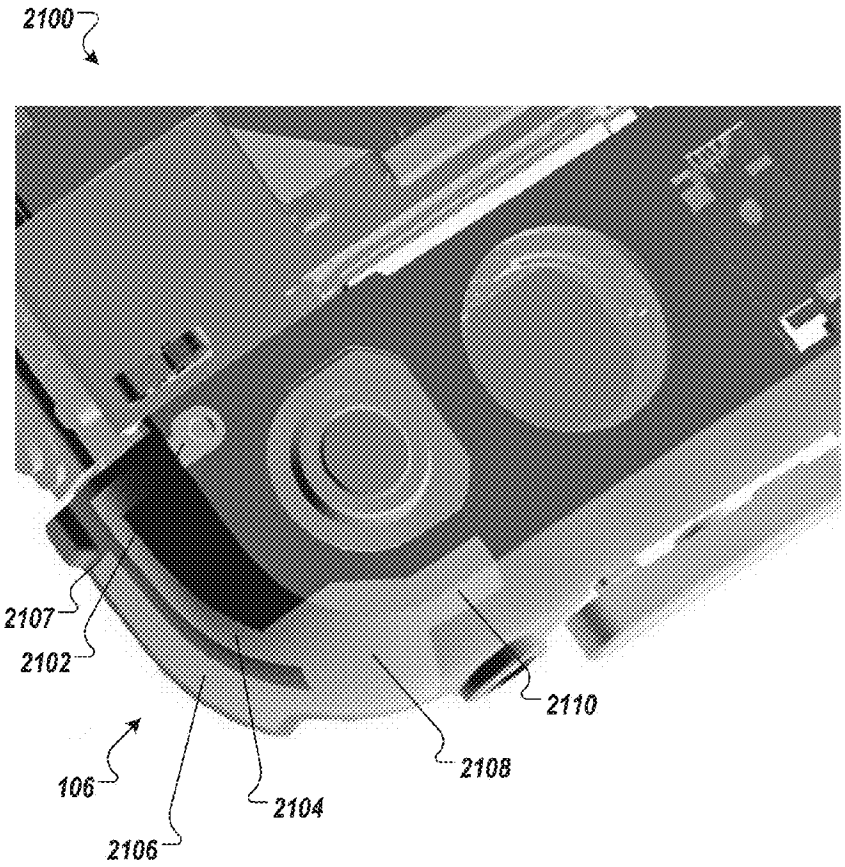

FIGS. 21A-21B include a perspective rear view and a perspective front view of an integrated high-band diversity/GPS antenna 2100 according to one embodiment. The integrated high-band diversity/GPS antenna 2100 can be disposed at the third corner 302 of the top side 300 of the user device, as illustrated in FIG. 3. For example, the integrated high-band diversity/GPS antenna 2100 can be disposed on an antenna carrier that is disposed at a top side of the user device. The folded monopole element, as described herein, can be disposed on the antenna carrier at a top corner of the antenna carrier. The integrated high-band diversity/GPS antenna 2100 is coupled to the RF circuitry on the PCB. The RF circuitry on the PCB drives a single radiation frequency (RF) feed near a RF feed point 2102. In one embodiment, the integrated high-band diversity/GPS antenna 2100 is disposed on an antenna carrier, such as a dielectric carrier of the user device. It should be noted that the integrated high-band diversity/GPS antenna 2100 illustrated in FIGS. 21A-21B is a three-dimensional (3D) structure. However, as described herein, the integrated high-band diversity/GPS antenna 2100 may include two-dimensional (2D) structures, as well as other variations than those depicted in FIGS. 21A-21B.

The integrated high-band diversity/GPS antenna 2100 includes a folded monopole structure. The folded monopole structure includes a first arm 2104, a second arm 2106, a widened portion 2108 and an extension portion 2110. The first arm 2104 extends in a first direction from the RF feed point 2102 until a first fold, and from the first fold the first arm 2104 extends in a second direction until the widened portion 2108. The second arm 2106 extends back in a third direction that is opposite the second direction towards a distal end 2107. The second arm 2106 forms a gap with a portion of the first arm 2104. The extension portion 2110 extends out in a fourth direction that is opposite the first direction. In other embodiments, some portions of the second arm 2106 are parallel to corresponding portions of the first arm 2104. In the depicted embodiment, portions of the first arm 2104, widened portion 2018 and extension portion 2110 are disposed on a top surface (rear surface) of the user device, and portions of the first arm 2104, second arm 2106, widened portion 2108 and extension portion 2110 are folded onto a second side of the antenna carrier as illustrated in FIG. 21A. This can be done to fit the integrated high-band diversity/GPS antenna 2100 in a smaller volume while maintaining the overall length of the antenna structure.

The GPS antenna of the integrated high-band diversity/GPS antenna 2100 covers GPS L1 and GNSS technologies with high sensitivity while the High-band diversity antenna of the integrated high-band diversity/GPS antenna 2100 covers B3, B4, B2, B1, WCS, and Band 7 for more international roaming. These multiple frequency bands span from 1.55 GHz 2.7 GHz. In one embodiment, the high-band diversity antenna is connected to a WAN module (also referred to as WAN chip), which may be located in the middle-bottom portion of the PCB, the antennas radiation region is chosen on the top right corner (in the perspective of facing the rear side of the user device). Generally, RF circuitry can be organized into different RF modules to control respective communication technologies. For example, the WAN module can be used to communicate over LTE networks, while a WLAN module can be used to communicate over a WLAN (e.g., Wi-Fi® network). Similarly, a GPS module can be used to receive GPS signals. The GPS module may include a GPS receiver. The RF modules may include one or more transceivers, power amplifiers, impedance circuits, or the like. Also, WAN modules can be configured to send and receive WAN signals, and a GPS module can be configured to receive GPS signals.

The top right corner area may be easier for efficiency wide band radiation and antenna around this area could be connected to the WAN chip with the shorter transmission lines. Also, the flex routing schemes along the peninsula region is not preferred for transmission lines routing if the antenna system is deployed on the top left corner. Specifically, the high speed signal lanes for audio, camera functionalities are so crowded and noisy to accommodate additional high frequency WAN signal lines with good isolations. Consequently, the integrated high-band diversity/GPS antenna 2100 is deployed on the top right corner, as shown in FIG. 2, while the rest of the top portion clearance is reserved for the Dual-Band Wi-Fi and LB diversity (B17, B20, B5, and B8) antennas.

Typical a GPS antenna element for GPS may be about 25 mm long to achieve λ/4 resonance. Compared to that, the volume in the top right corner is very small to compromise the existence of other components (RFC, corner camera, flash circuits, flash and bling rings). To utilize the radiations volume effectively: First, a height (+z) may be achieved by adopting the LDS technology to gain 0.5 mm over the antenna. The antenna metal may be placed between LDS and Nylon with 50% glass, which is an additional layer to strengthen the structure other than the TPU. Second, the sides of the corner within LDS tooling are effectively utilized. Moreover, different antenna types may be used. For examples, various combinations of PIFA, monopole, parasitic element, and a folded monopole. The folded monopole structure of FIG. 21 covers the wide band radiation needed.

The dimensions of the integrated high-band diversity/GPS antenna 2100 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another. The integrated high-band diversity/GPS antenna 2100 may have various dimensions based on the various design factors.

Figure 23:
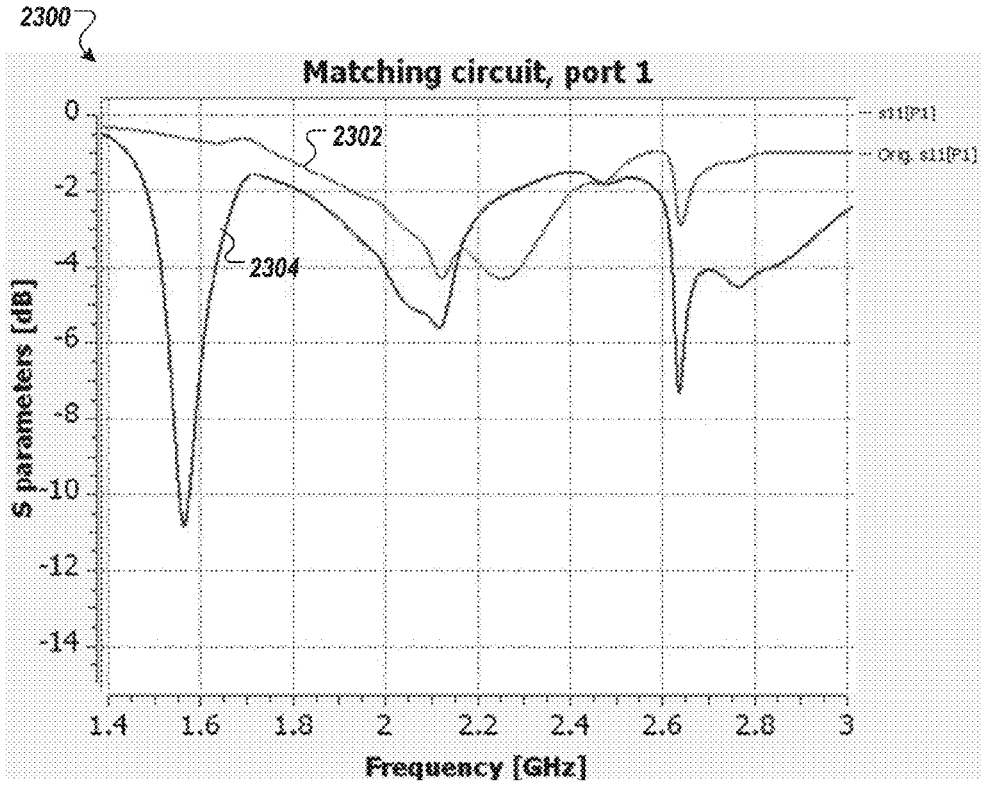
FIG. 23 is a graph of return loss of the integrated high high-band diversity/GPS antenna of FIG. 21 with and without pre-matching circuitry according to one embodiment.

As described herein, strong resonances are not easily achieved within a compact space within user devices, especially within the spaces on smart phones and tablets. The structure of the integrated high-band diversity/GPS antenna 2100 of FIGS. 21A-21B provides strong resonances as illustrated in FIG. 23

Figure 22:
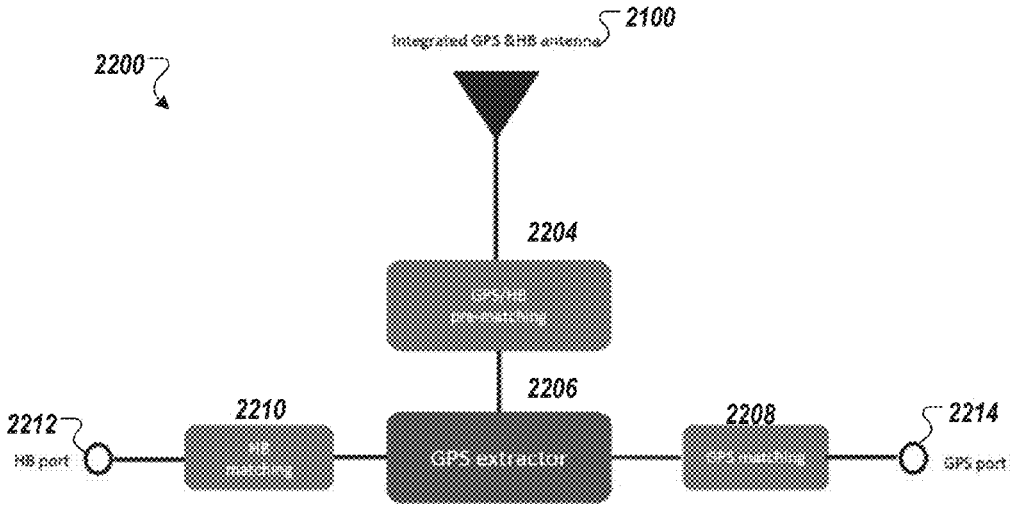
FIG. 22 is a block diagram of an impedance matching network including a GPS extractor for the integrated high high-band diversity/GPS antenna of FIG. 21 according to one embodiment.

To facilitate the functionalities of HB diversity and GPS systems, a single feed structure is connected to a GPS extractor with one port (GPS port) going to a GPS module and another port (WAN port) passing through all the high bands (B3, B4, B2 B1, WCS, and Band 7) to the WAN module, such as illustrated in FIG. 22. Alternatively, there may be two separated GPS and High Band antennas, and the GPS antenna is connected to a GPS pre-filter instead.

FIG. 22 is a block diagram of an impedance matching network 2200 including a GPS extractor 2206 for the integrated high-band diversity/GPS antenna 2100 of FIG. 21 according to one embodiment. A HB port 2212 is connected to the WAN module and the GPS port 2214 is connected to the GPS module. The WAN module is the RF circuitry on the PCB that controls WAN communications via the integrated high-band diversity/GPS antenna 2100. The GPS module is the RF circuitry on the PCB that controls GPS signals received via the integrated high-band diversity/GPS antenna 2100. The GPS extractor 2206 is coupled to the HB port 2212 and the GPS port 2214. HB matching circuitry 2210 (also referred to as WAN impedance matching circuitry) may be coupled between the GPS extractor 2206 and the HB port 2212. HB matching circuitry 2210 may include a shunt capacitor. Alternatively, the HB matching circuitry 2210 may include an antenna tuner. GPS matching circuitry 2208 (also referred to as GPS impedance matching circuitry) may be coupled between the GPS extractor 2206 and the GPS port 2214. Also, GPS/HB pre-matching circuitry 2204 may be coupled between the GPS extractor 2206 and the integrated high-band diversity/GPS antenna 2100.

In one embodiment, the GPS extractor 2206 is a diplexer. The diplexer may be diplexers developed by Epochs, Murata, and Avago, as well as other manufactures of diplexers. A diplexer may be selected that performs well in terms of GPS insertion loss, but also more tolerant with antenna impedance values on the rest of the HB frequency ranges.

In one embodiment, the GPS/HB pre-matching circuitry 2204 may be used to minimize the possible mismatch loss. In the free space condition, the original return loss of the optimized antenna is shown in FIGS. 23.

Figure 24:
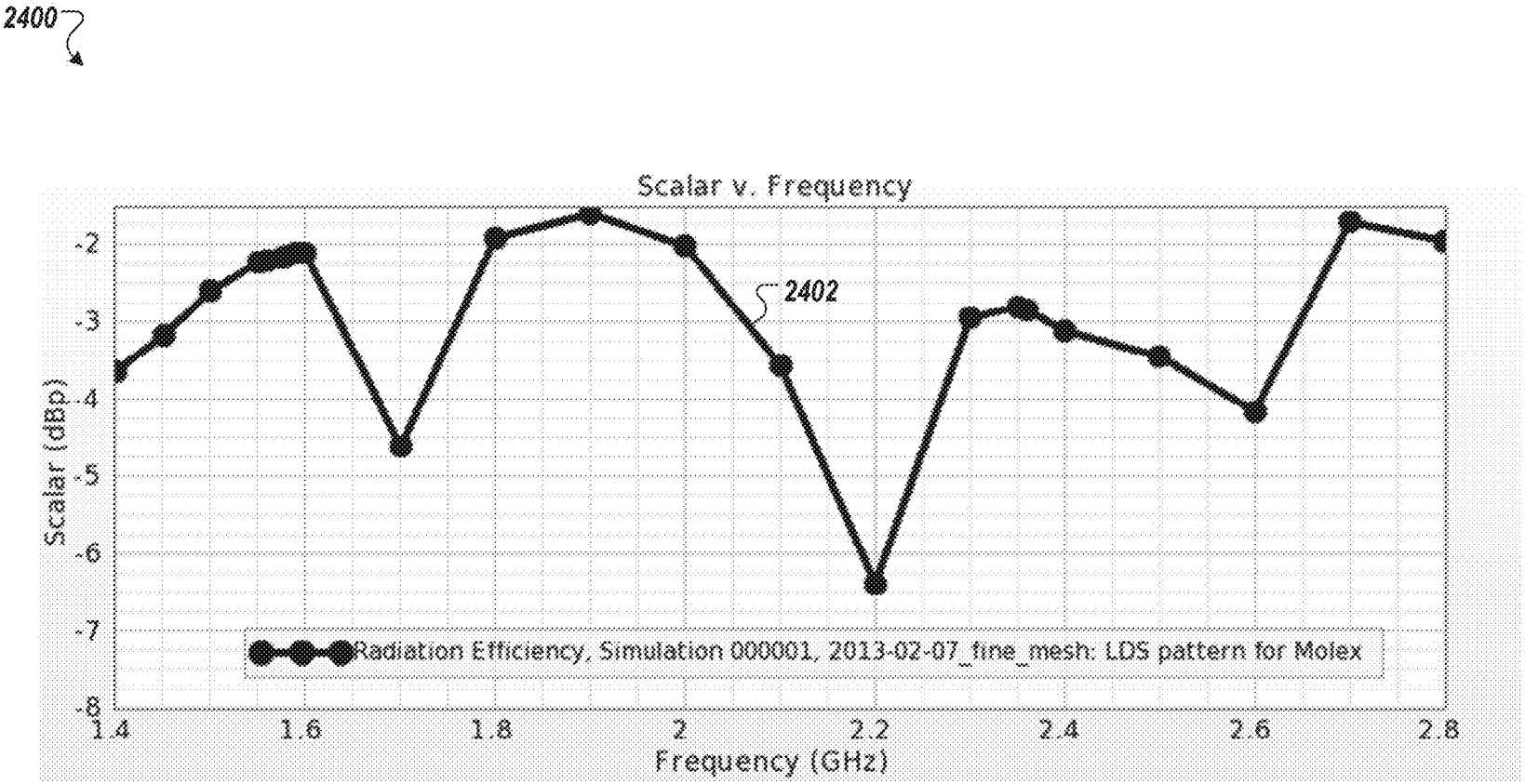
FIG. 24 is a graph of radiation efficiency of the integrated high high-band diversity/GPS antenna of FIG. 21 according to one embodiment.

FIG. 23 is a graph 2300 of return loss of the integrated high-band diversity/GPS antenna 2100 of FIG. 21 with and without pre-matching circuitry according to one embodiment. The graph 2300 shows a return loss 2302 of the integrated high high-band diversity/GPS antenna without pre-matching circuitry and a return loss 2304 of the integrated high-band diversity/GPS antenna 2100 with the pre-matching circuitry 2204. As shown in FIG. 23, there is deep matching around GPS frequencies, the shifted matching for B4, B2 RX, and an improved matching for B7 RX. In terms of the intrinsic antenna efficiency, it has a profile as shown in FIG. 24. FIG. 24 is a graph 2400 of radiation efficiency 2402 of the integrated high high-band diversity/GPS antenna of FIG. 21 according to one embodiment.

The integrated high-band diversity/GPS antenna 2100 of FIG. 21 can cover B3, B4, B2, WCS and B7 bands for HB diversity and can cover GPS and B4 and B2 OTA specifications.

Auxiliary Antennas: Dual-Band WLAN/PAN Antenna

Figure 25:
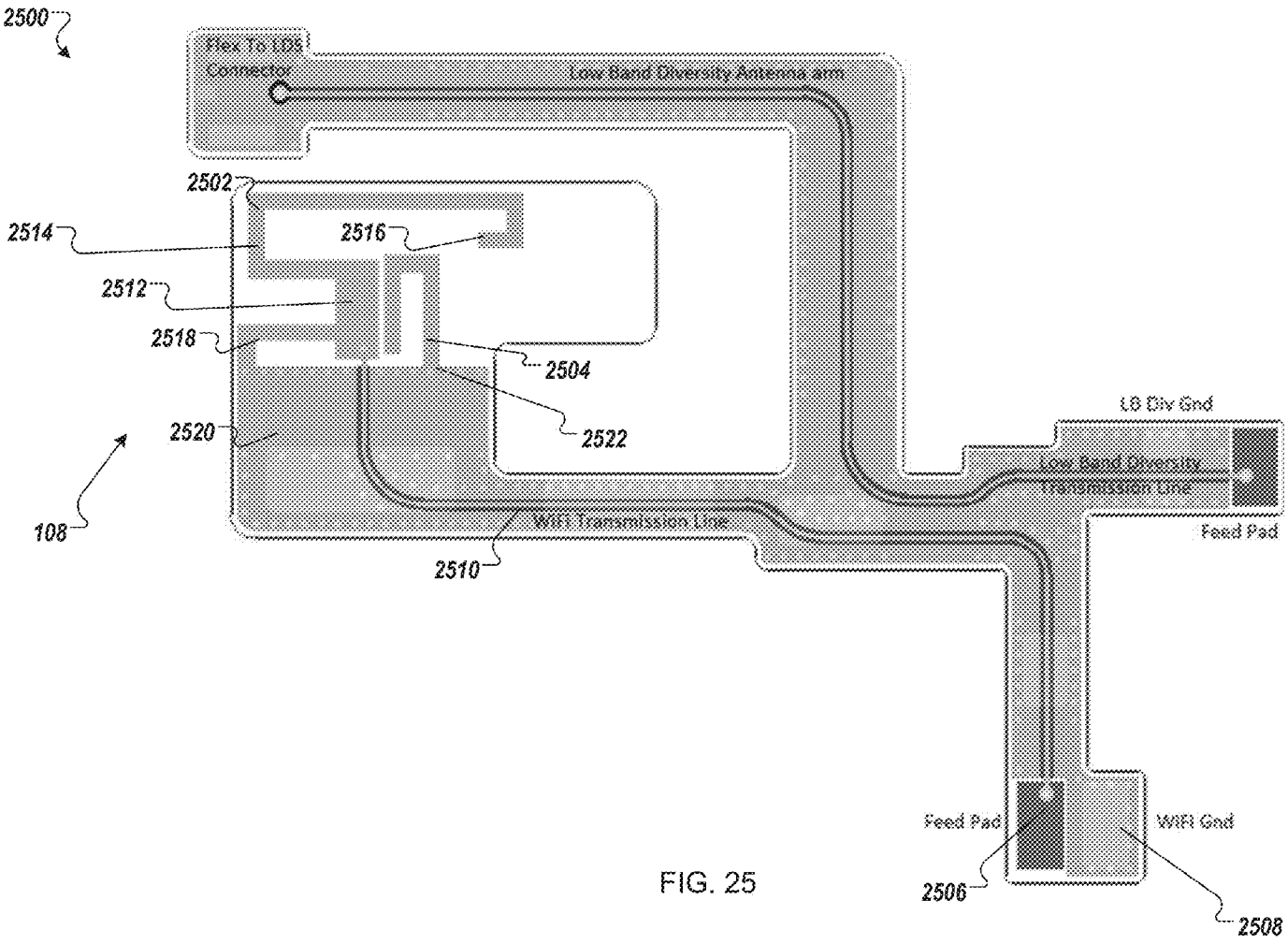
FIG. 25 is a rear view of a dual-band WLAN/PAN antenna according to one embodiment.

FIG. 25 is a rear view of a dual-band WLAN/PAN antenna 2500 according to one embodiment. The dual-band WLAN/PAN antenna 2500 is the fifth antenna 108 of FIG. 1. The dual-band WLAN/PAN antenna 2500 (hereinafter referred to as the dual-band antenna 2500) may be implemented by flex printed circuitry technology and placed under the rear housing of the device chassis. The dual-band antenna 2500 can cover WLAN frequency bands and PAN frequency bands, such as 2.4 GH and 5 GHz ISM band) with a single feed. The dual-band antenna 2500 can be separated into two parts, an inverted-F antenna structure (IFA structure) 2502 and a shorted parasitic arm 2504. The IFA structure 2502 is designed to resonant at the low band 2.44 GHz, which is the center frequency of 2.4 GHz for the Wi-Fi® and Bluetooth® bands. The shorted parasitic arm 2504 is designed to couple with the IFA structure 2502 and resonant at the 5.5 GHz, which is the center frequency of 5 GHz Wi-Fi® band.

FIG. 25 shows the antenna placement on the top of the device (on the rear side). The dual-band antenna 2500 is in close proximity to electro-mechanical parts (e.g. audio jack, flex branch for low band diversity antenna, side key flex, etc.), low band diversity antenna, high band diversity antenna and GPS antenna. Despite the placement of the dual-band antenna 2500 in this environment, the dual-band antenna 2500 is designed to have acceptable antenna performance.

The dual-band antenna 2500 is coupled to a RF feed 2506, such as by a feed pad, and coupled to a ground point 2508. A transmission line 2510 is coupled between the RF feed 2506 and the IFA structure 2502. The transmission line 2510 can be printed on the flexible circuitry material disposed underneath the device chassis. In one embodiment, the transmission line embedded within an L-shaped grounding strip. The end of the ground strip can be sandwiched between a bracket and the FFC connector. The L-shaped grounding strip can make the connection to a metal bracket on flexible material with audio lines. In another embodiment, a spring clip (or connection) can be added between the bracket and the flex circuitry material for the transmission line 2510.

In one embodiment, the IFA structure 2502 includes a base arm 2512 that extends from a point where the transmission line 2510 is connected to the IFA structure towards a first fold in a first direction. From the first fold, a first arm 2514 extends from the base arm 2512 in a second direction to a second fold and from the third fold to a fourth fold in the first direction. From the fourth fold, the first arm 2514 extends in a third direction that is opposite the second direction towards a fifth fold, and in a fourth direction that is opposite the first direction towards a sixth fold. The first arm 2514 extends in the second direction again to a distal end 2516. The IFSA structure 2502 also includes a second arm 2518 that extends from the base arm 2512 in the second direction to a seventh fold and extends from the seventh fold to a ground plane 2520.

In one embodiment, the shorted parasitic arm 2504 includes a folded arm that extends from a ground point 2522 at the ground plane 2520 in the first direction towards an eighth fold, and in the second direction from the eight fold to a ninth fold, and back in the fourth direction back towards the ground plane 2520 but not connected to the ground plane 2520.

Figure 26:
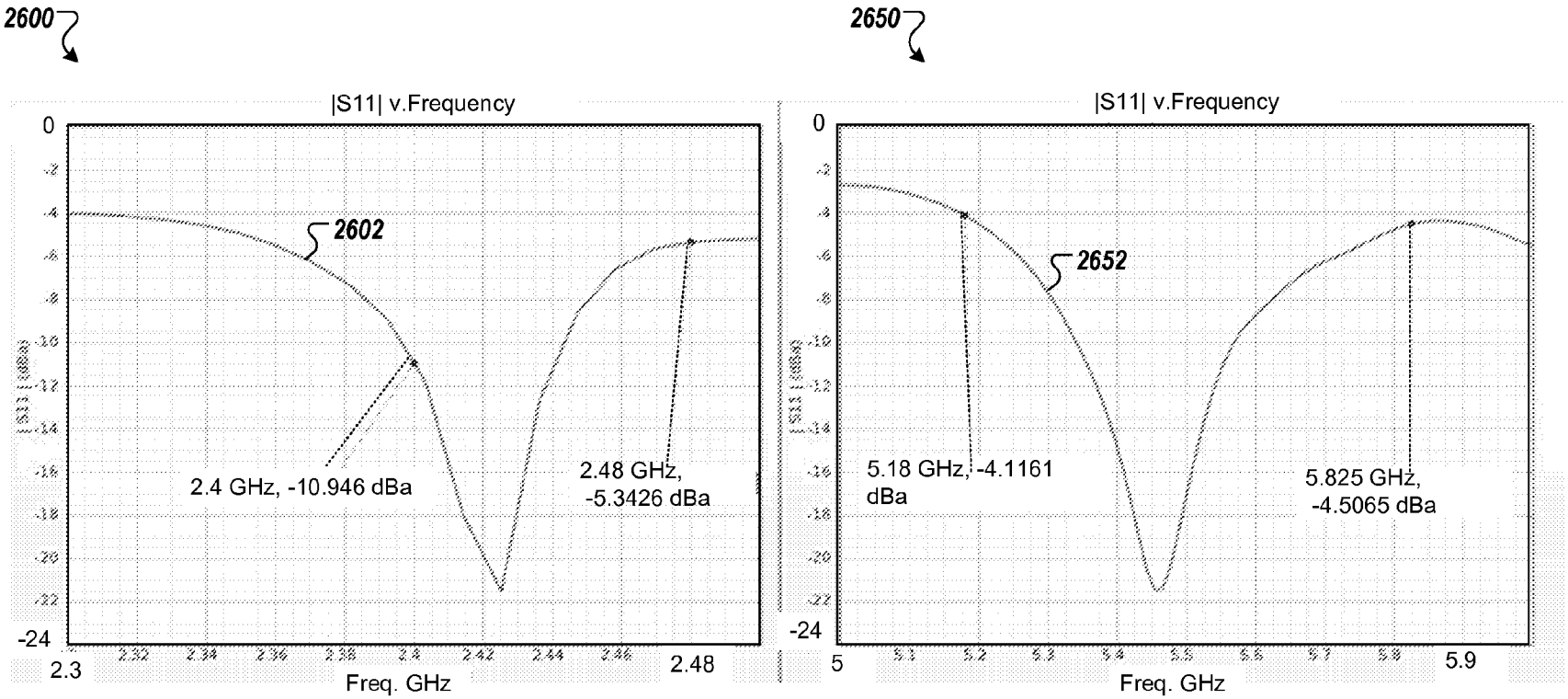
FIG. 26 includes graphs of return loss of the dual-band WLAN/PAN antenna of FIG. 25 according to one embodiment.

FIG. 26 includes graphs 2600, 2650 of return loss of the dual-band WLAN/PAN antenna 2500 of FIG. 25 according to one embodiment. The graph 2600 illustrates the dual-band WLAN/PAN antenna 2500 in free space. The graph 2600 shows the 2.4 GHz return loss 2602 and graph 2650 shows the 5 GHz antenna return loss 2652 in free space. For example, the 2.42 GHz resonance has a −6 dB bandwidth of 4.1%, and the 5.45 GHz resonance has a −6 dB bandwidth of 8.4%. Thus, the dual-band WLAN/PAN antenna 2500 can be caused to radiate electromagnetic energy in a dual-band, including a first band between approximately 2.3 GHz to 2.5 GHz and a second band between approximately 5.2 GHz to 5.8 GHz.

Figure 27:
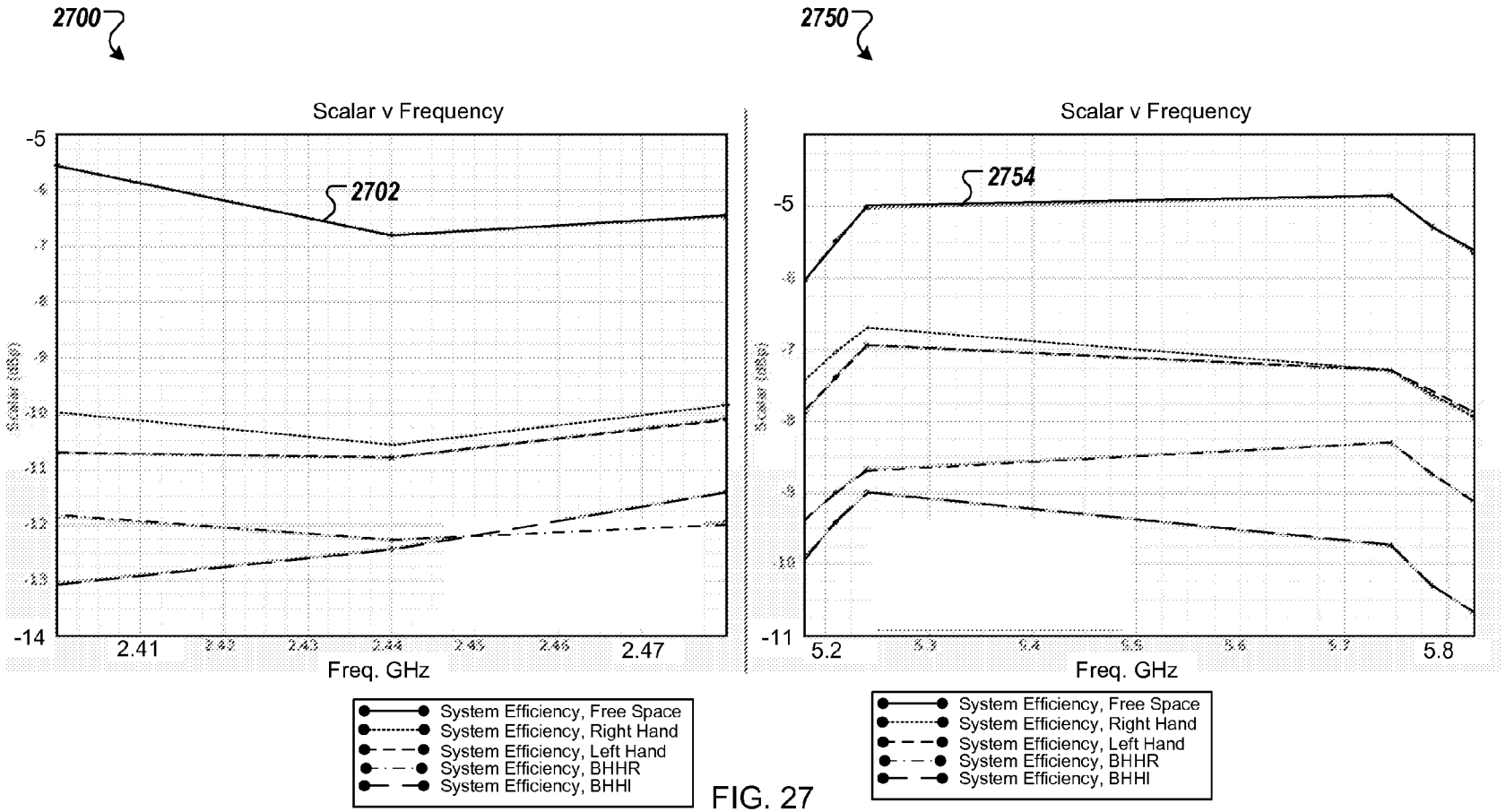
FIG. 27 includes graphs of measured efficiencies of the dual-band WLAN/PAN antenna of FIG. 25 according to one embodiment.

FIG. 27 includes graphs 2700, 2750 of measured efficiencies 2702, 2752 of the dual-band WLAN/PAN antenna 2500 of FIG. 25 according to one embodiment. The graph 2700 illustrates radiation efficiency of the 2.4 GHz/5 GHz antenna for different test cases. The graph 2700 shows the measured efficiency 2702 of a first band of the 2.4 GHz and graph 2750 shows the measured efficiency 2752 of a second band of 5 GHz. It should be noted that graphs does not include the loss introduced by the flex strip line and spring contacts, but there may be about 1 dB loss in 2.4 GHz band, and about 1.5 dB loss in 5.5 GHz band from the flex strip line and spring contacts. The graph 2700 illustrates that the dual-band WLAN/PAN antenna 2500 is a viable antenna for dual-band WLAN frequency ranges and PAN frequency ranges.

Figure 28:
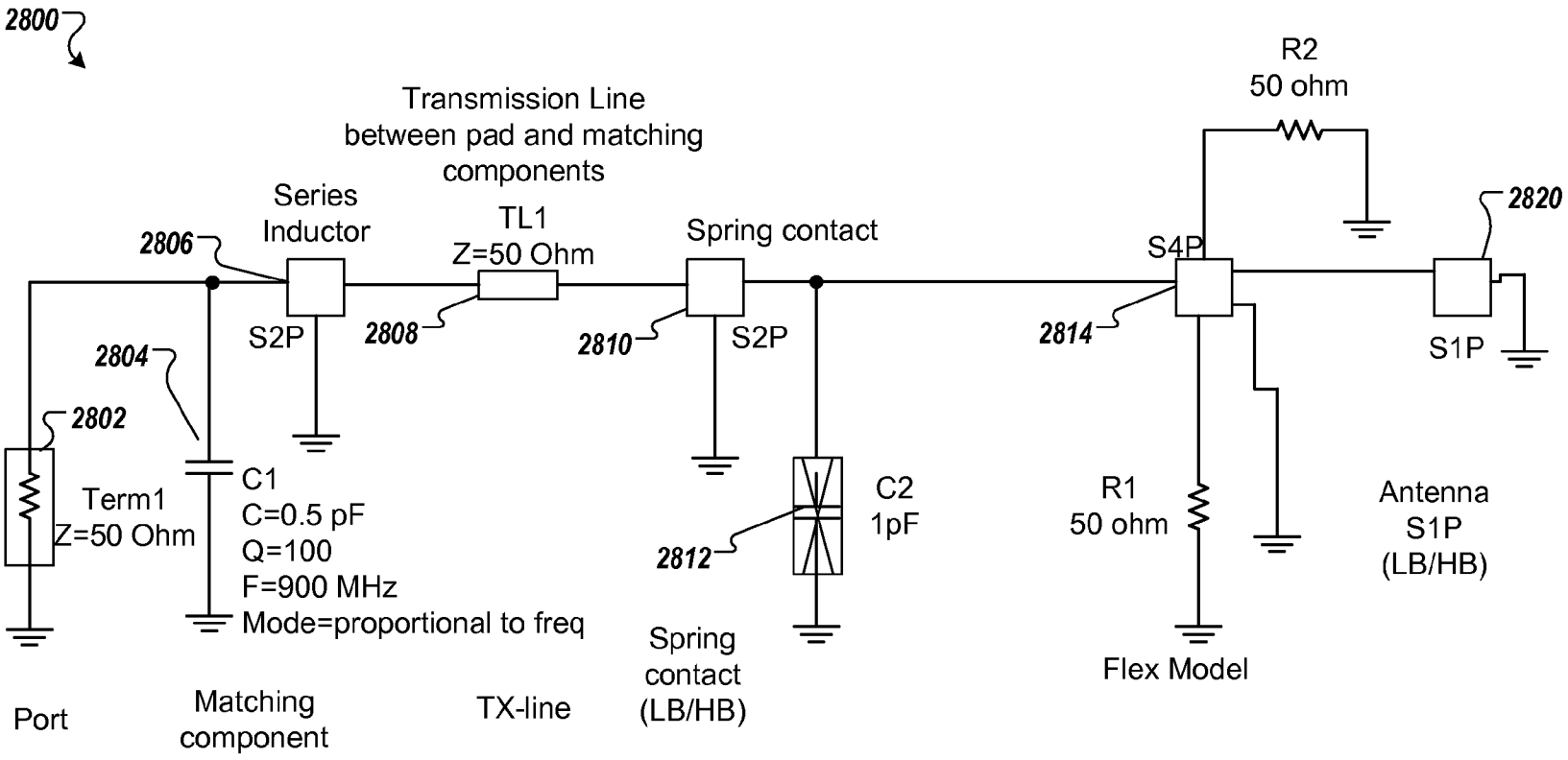
FIG. 28 is an equivalent circuit diagram of an impedance matching network for the dual-band WLAN/PAN antenna of FIG. 25 according to one embodiment.

FIG. 28 is an equivalent circuit diagram of an impedance matching network 2800 for the dual-band WLAN/PAN antenna of FIG. 25 according to one embodiment. The impedance matching network 2800 includes a shunt capacitor 2804 coupled in parallel to an RF feed port 2802. A series inductor 2806 is coupled between a transmission line 2808 and the RF feed port 2802. The transmission line 2808 is coupled to a sprint contact 2810 in series, and a spring contact 2812 in parallel to ground. An antenna element 2814 is coupled to the spring contact 2810 in series. A parasitic element 2820 parasitically couples to the antenna element 2814.

Figure 29:
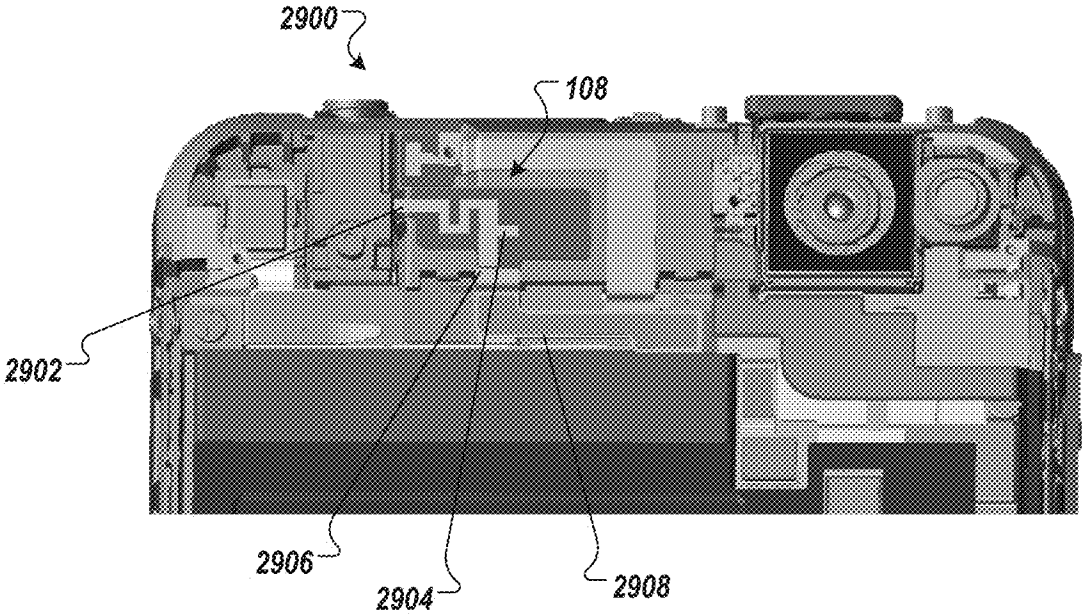
FIG. 29 is a rear view of a dual-band WLAN/PAN antenna according to another embodiment.

FIG. 29 is a rear view of a dual-band WLAN/PAN antenna 2900 according to another embodiment. The dual-band WLAN/PAN antenna 2900 is the fifth antenna 108 of FIG. 1. The dual-band WLAN/PAN antenna 2590 (hereinafter referred to as the dual-band antenna 2900) may be implemented by flex printed circuitry technology and placed under the rear housing of the device chassis. The dual-band antenna 2900 can cover WLAN frequency bands and PAN frequency bands, such as 2.4 GH and 5 GHz ISM band) with a single feed. The dual-band antenna 2900 is a dual band inverted-L type antenna. A first arm 2902 is primarily for the low band (LB) and a second arm 2904 is primarily for high band (HB). The first arm 2902 is designed to resonant at the low band 2.44 GHz, which is the center frequency of 2.4 GHz for the Wi-Fi® and Bluetooth® bands. The second arm 2904 is designed to resonant at the 5.5 GHz, which is the center frequency of 5 GHz Wi-Fi® band.

FIG. 29 shows the antenna placement on the top of the device (on the rear side). The dual-band antenna 2900 is in close proximity to electro-mechanical parts (e.g. audio jack, flex branch for low band diversity antenna, side key flex, etc.), low band diversity antenna, high band diversity antenna and GPS antenna. Despite the placement of the dual-band antenna 2900 in this environment, the dual-band antenna 2900 is designed to have acceptable antenna performance.

The dual-band antenna 2900 is coupled to a RF feed 2906. A transmission line 2908 is coupled between the RF feed 2906 and the RF circuitry on the PCB as described herein. The transmission line 2908 can be printed on the flexible circuitry material disposed underneath the device chassis. In one embodiment, the transmission line embedded within an L-shaped grounding strip. The end of the ground strip can be sandwiched between a bracket and the FFC connector. The L-shaped grounding strip can make the connection to a metal bracket on flexible material with audio lines. In another embodiment, a spring clip (or connection) can be added between the bracket and the flex circuitry material for the transmission line 2908.

In one embodiment, the first arm 2902 extends out from a base portion coupled to the RF feed 2906. The first arm 2902 extends out from the base portion in a first direction to a distal end. In order to get additional length, there may be one or more folds in the first arm. In the depicted embodiment, there are four folds in the first arm 2094. The second arm 2904 extends out from the base portion in a second direction that is opposite the first direction. The second arm 2904 extends out a second length. The second length of the second arm 2904 contributes to the 5 GHz band. In a further embodiment, an additional arm extends out from the distal end of the first arm, extending the first arm in a third direction opposite from the RF feed. The length of the first arm 2902 (including the additional arm) contributes to the 2.4 GHz band.

Figure 30:
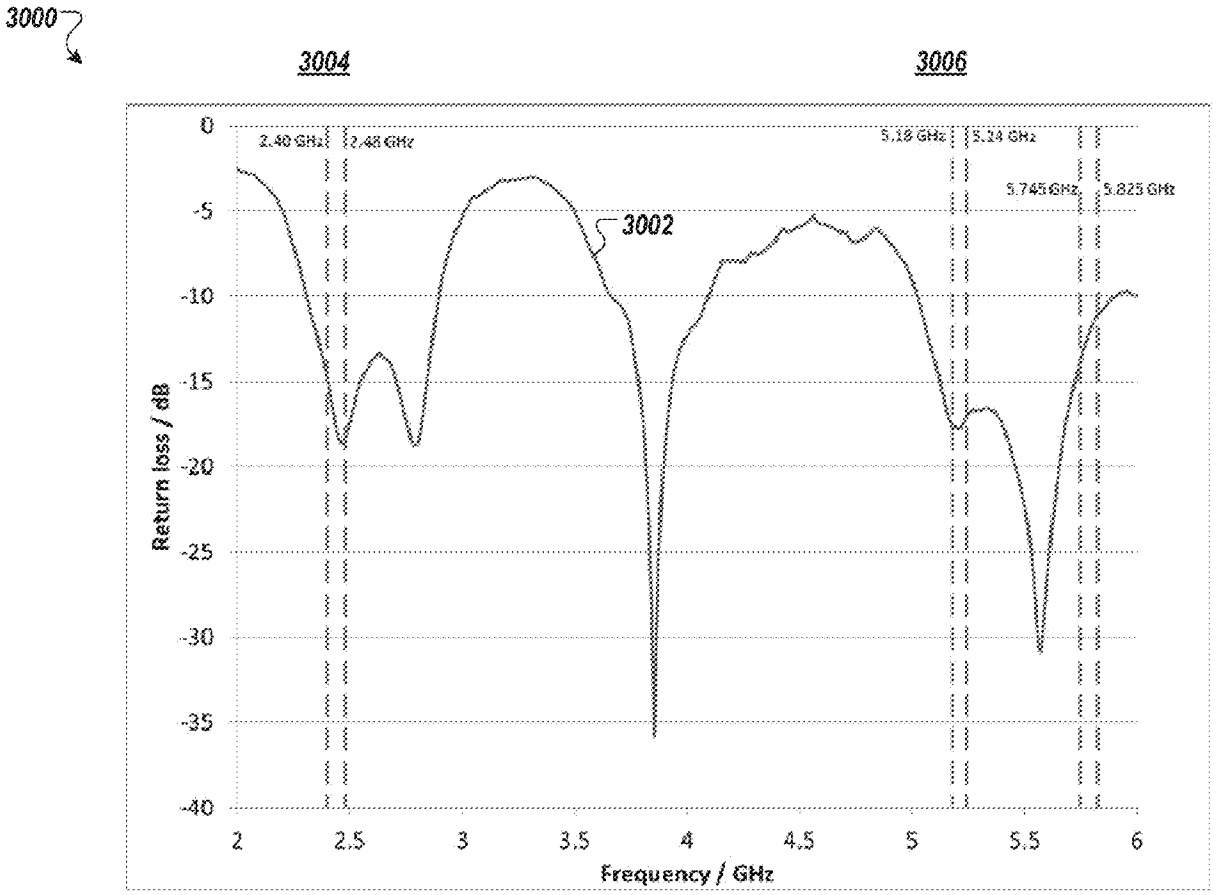
FIG. 30 is a graph of return loss of the dual-band WLAN/PAN antenna of FIG. 29 according to one embodiment.

FIG. 30 is a graph of return loss of the dual-band WLAN/PAN antenna of FIG. 29 according to one embodiment. The graph 3000 illustrates the dual-band WLAN/PAN antenna 2900 in free space. The graph 2900 shows the return loss 3002 in the LB 3004 (2.4 GHz band) and in the HB 3006 (5 GHz band). Thus, the dual-band WLAN/PAN antenna 2900 can be caused to radiate electromagnetic energy in a dual-band, including a first band between approximately 2.3 GHz to 3 GHz and a second band between approximately 4.6 GHz to 6 GHz.

Figure 31:
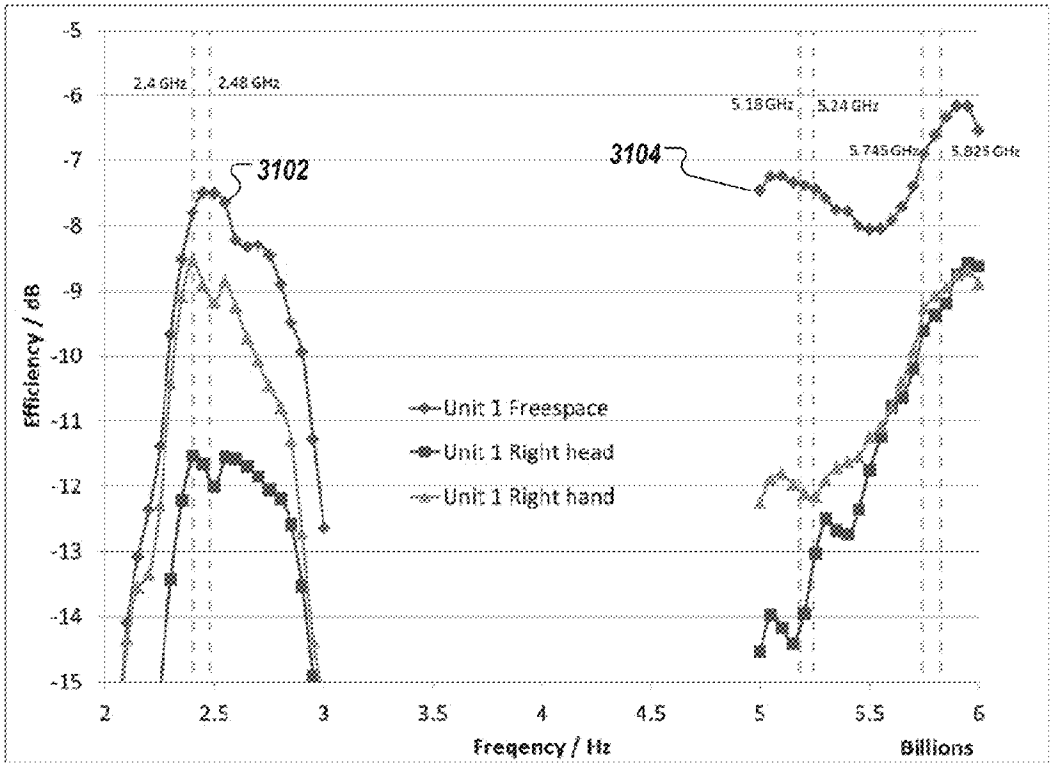
FIG. 31 is a graph of measured efficiencies of the dual-band WLAN/PAN antenna of FIG. 29 according to one embodiment.

FIG. 31 is a graph of measured efficiencies of the dual-band WLAN/PAN antenna of FIG. 29 according to one embodiment. The graph 3100 illustrates radiation efficiency of the 2.4 GHz/5 GHz antenna for different test cases. The graph 3100 shows the measured efficiency 3102 of a first band of the 2.4 GHz and the measured efficiency 3104 of a second band of 5 GHz. The graph 3100 illustrates that the dual-band WLAN/PAN antenna 2900 is a viable antenna for dual-band WLAN frequency ranges and PAN frequency ranges.

Auxiliary Antennas: Antenna 6 NFC

As described above, the user device may include a sixth NFC antenna (not illustrated 1) may be used, such as under a plastic insert within an opening in a device chassis. The user device may also include a RFID tag, as well as other types of antennas. NFC communication is essentially a transformer system that operates at 13.56 MHz, with an active source on one end (reader mode), and a variable load on the other end (card mode). The NFC antennas are basically a coupled inductor system. One serves as the transducer that converts electric current to magnetic field and vice versa. Since the antenna has to act as an inductor, it is important to note that unlike a classic antenna, it does not operate at its resonance frequency, and its resistance has to be minimized instead of match to 50 ohms. As such, NFC antenna is evaluated like an inductor. It needs to be placed in device environment, and measure its 2-port S-parameter with a VNA to obtain the S2P. The following table includes the recommend circuit parameters for the NFC coil.

| | NFC Antenna | | | | | |
|---|---|---|---|---|---|---|
| Sample | L (μH) | Rs (Ω) | Rp (Ω) | Ca (pF) | Fres (MHz) | Q |
| Spec | 1-2 | <1 | >1000 | 3-30 | >25 | >15 |

The following antenna characteristics of the NFC antenna and their implications on the performance are described below:

Inductance (L)—Higher inductance will allow higher coupling with external reader, thereby increase the operating range. However, over-coupling could happen when the separation between reader and card is small. When this happens, either the reader or card or both can be detuned, and the NFC operation may fail. For a 30×50 mm size antenna, a 4 to 5 turn antenna will typically yield an inductance value within this range.

Series Resistance (Rs)—Series resistance is the loss element for the transformer system. In battery off operation, NFC antenna relies on extracting energy from the external reader field. High series resistance will reduce the power transfer.

Parallel Resistance (Rp)—Parasitic element of the antenna.

Parallel Capacitance (Ca)—Parasitic element of the antenna. Can be contributed by the capacitance between the coil traces and the capacitance between the coil and surrounding metal.

Self-Resonance Frequency (Fres)—The antenna needs to act as an inductor at 13.56 MHz, so the self-resonance frequency needs to be as high as possible.

Quality Factor (Q)—The quality factor affects the shape of the time domain waveform. ISO specifies the rise time, fall time, and overshoot of the reader mode waveform. For compact mobile devices, it is highly improbable to have too high of quality factor, hence only the lower limit is specified here.

In one embodiment, the NFC antenna is located in the rear cover assembly, sandwiched between an aluminum stiffener and a rear cover glass. The antenna dimension is up to 34 mm×54.5 mm×0.15 mm. Due to device thickness constraints, only 0.07 mm thick ferrite could be used. Ferrite is an important part of the NFC antenna construction, as it isolates the antenna from the metal surface the antenna is sitting on. The thicker the ferrite, the more isolation there is, the better the NFC performance will be. A hole in the stiffener is opened for the antenna to transit into the inside of the device and to make contact with the PCB.

Figure 32:
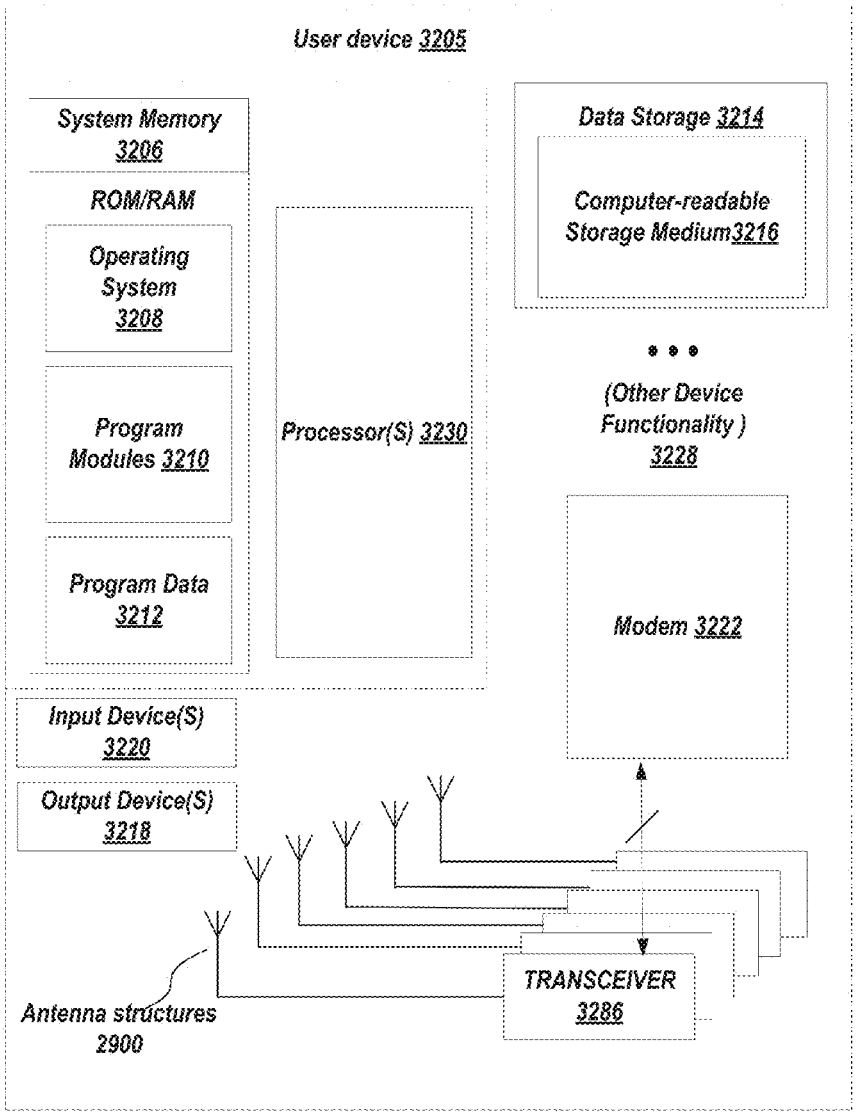
FIG. 32 is a block diagram of a user device in which embodiments of antenna structures may be implemented.

FIG. 32 is a block diagram of a user device 3205 in which embodiments of antenna structures 3200 may be implemented. The user device 3205 includes one or more processors 3230, such as one or more CPUs, microcontrollers, field programmable gate arrays, or other types of processing devices. The user device 3205 also includes system memory 3206, which may correspond to any combination of volatile and/or non-volatile storage mechanisms. The system memory 3206 stores information, which provides an operating system component 3208, various program modules 3210, program data 3212, and/or other components. The user device 3205 performs functions by using the processor(s) 3230 to execute instructions provided by the system memory 3206.

The user device 3205 also includes a data storage device 3214 that may be composed of one or more types of removable storage and/or one or more types of non-removable storage. The data storage device 3214 includes a computer-readable storage medium 3216 on which is stored one or more sets of instructions embodying any one or more of the functions of the user device 3205, as described herein. As shown, instructions may reside, completely or at least partially, within the computer-readable storage medium 3216, system memory 3206 and/or within the processor(s) 3230 during execution thereof by the user device 3205, the system memory 3206 and the processor(s) 3230 also constituting computer-readable media. The user device 3205 may also include one or more input devices 3220 (keyboard, mouse device, specialized selection keys, etc.) and one or more output devices 3218 (displays, printers, audio output mechanisms, etc.).

The user device 3205 further includes a wireless modem 3222 to allow the user device 3205 to communicate via a wireless network (e.g., such as provided by a wireless communication system) with other computing devices, such as remote computers, an item providing system, and so forth. The wireless modem 3222 allows the user device 3205 to handle both voice and non-voice communications (such as communications for text messages, multimedia messages, media downloads, web browsing, etc.) with a wireless communication system. The wireless modem 3222 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 3222 may communicate according to different communication types (e.g., WCDMA, GSM, LTE, CDMA, WiMax, etc.) in different cellular networks. The cellular network architecture may include multiple cells, where each cell includes a base station configured to communicate with user devices within the cell. These cells may communicate with the user devices 3205 using the same frequency, different frequencies, same communication type (e.g., WCDMA, GSM, LTE, CDMA, WiMax, etc.), or different communication types. Each of the base stations may be connected to a private, a public network, or both, such as the Internet, a local area network (LAN), a public switched telephone network (PSTN), or the like, to allow the user devices 3205 to communicate with other devices, such as other user devices, server computing systems, telephone devices, or the like. In addition to wirelessly connecting to a wireless communication system, the user device 3205 may also wirelessly connect with other user devices. For example, user device 3205 may form a wireless ad hoc (peer-to-peer) network with another user device.

The wireless modem 3222 may generate signals and send these signals to transceivers 3280 for amplification, after which they are wirelessly transmitted via the antenna structures 3200. Although FIG. 32 illustrates the transceivers 3280, in other embodiments, a power amplifier (power amp) may be used for the antenna elements 3202 to transmit and receive RF signal. Or, receivers may be used instead of transceivers, such as a GPS receiver. The antenna structures 3200 may be any directional, omnidirectional or non-directional antenna in a different frequency band. In addition to sending data, the antenna structures 3200 also can receive data, which is sent to wireless modem 3222 and transferred to processor(s) 3230. The user device 3205 may include zero or more additional antennas (not illustrated) other than antenna structures 3200. When there are multiple antennas, the user device 3205 may also transmit information using different wireless communication protocols. It should be noted that, in other embodiments, the user device 3205 may include more or less components as illustrated in the block diagram of FIG. 32. The antenna structures 3200 are the antenna structures described with respect to FIGS. 1-31. Alternatively, the antenna structures 3200 may be other variants of the antenna structures as described herein.

In one embodiment, the user device 3205 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates in a first frequency band and the second wireless connection is associated with a second resonant mode of the antenna structure that operates in a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a wireless modem 3222 is shown to control transmission and reception via antenna structures 3200, the user device 3205 may alternatively include multiple wireless modems, each of which is configured to transmit/receive data via a different antenna and/or wireless transmission protocol.

The user device 3205 delivers and/or receives items, upgrades, and/or other information via the network. For example, the user device 3205 may download or receive items from an item providing system. The item providing system receives various requests, instructions and other data from the user device 3205 via the network. The item providing system may include one or more machines (e.g., one or more server computer systems, routers, gateways, etc.) that have processing and storage capabilities to provide the above functionality. Communication between the item providing system and the user device 3205 may be enabled via any communication infrastructure. One example of such an infrastructure includes a combination of a wide area network (WAN) and wireless infrastructure, which allows a user to use the user device 3205 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 3205.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 3205 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 3205 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A user device comprising:

a display;

a device chassis;

a printed circuit board comprising radio frequency (RF) circuitry;

a primary antenna structure located at a bottom side of the device chassis, wherein the primary antenna structure comprises:

a first element located at a first corner of the bottom side and coupled to the RF circuitry, wherein the RF circuitry is operable to cause the first element to radiate or receive electromagnetic energy in a first frequency band; and a second element located at a second corner of the bottom side and coupled to the RF circuitry, wherein the RF circuitry is operable to cause the second element to radiate or receive electromagnetic energy in a second frequency band that is lower than the first frequency band;

a secondary receive (RX) antenna structure located at a top side opposing the bottom side of the device chassis, wherein the secondary RX antenna structure comprises:

a third element located at a first corner of the top side and coupled to the RF circuitry, wherein the RF circuitry is operable to cause the third element to receive electromagnetic energy in the first frequency band and to receive electromagnetic energy in a third frequency band, wherein the first frequency band is a wireless area network (WAN) frequency band and the third frequency band is a global positioning system (GPS) frequency band; and a fourth element located at a second corner of the top side and coupled to the RF circuitry, wherein the RF circuitry is operable to cause the fourth element to receive electromagnetic energy in the second frequency band.

2. The user device of claim 1, wherein the first element is a high-band WAN primary antenna that radiates or receives electromagnetic energy between approximately 1.69 GHz and approximately 3.0 GHz, the second element is a low-band WAN primary antenna that radiates or receives electromagnetic energy between approximately 700 MHz and approximately 960 MHz, the third element is an integrated high-band WAN secondary and GPS antenna that receives electromagnetic energy between approximately 1.5 GHz and approximately 1.7 GHz for GPS signals and receives electromagnetic energy between approximately 2.3 GHz and 3 GHz for WAN signals and the fourth element is a low-band WAN secondary antenna that receives electromagnetic energy between approximately 700 MHz and approximately 960 MHz.

3. The user device of claim 1, further comprising:

a WAN module;

a GPS module;

an impedance matching network, the impedance matching network comprising:

a WAN port coupled to the WAN module;

a GPS port coupled to the GPS module; and a diplexer coupled to the third element, the WAN port and the GPS port, the diplexer to direct GPS signals received by the third element to the GPS port and to direct WAN signals received by the third element to the WAN port.

4. The user device of claim 3, wherein the impedance matching network further comprises:

pre-matching circuitry coupled between the third element and the diplexer;

WAN impedance matching circuitry coupled between the WAN port and the diplexer; and GPS impedance matching circuitry coupled between the GPS port and the diplexer.

5. An apparatus comprising:

a single radio frequency (RF) feed;

a folded monopole element coupled to the single RF feed, wherein the folded monopole element is to receive electromagnetic energy in a first frequency range and to receive electromagnetic energy in a second frequency range, wherein the first frequency range is a wireless area network (WAN) frequency band and the second frequency range is a global navigation satellite system (GNSS) frequency band; and an impedance matching circuit coupled to the single RF feed, wherein the impedance matching circuit comprises:

a first port;

a second port; and a diplexer coupled to the single RF feed, the first port, and the second port, the diplexer to extract out GNSS frequency signals received by the folded monopole element from WAN signals received by the folded monopole element;

a first RF module coupled to the first port; and a second RF module coupled to the second port.

6. The apparatus of claim 5, wherein the folded monopole element operates as a high-band WAN secondary receive antenna to receive the electromagnetic energy in a WAN frequency band in the first frequency range, and wherein the folded monopole element operates as a global positioning system (GPS) antenna to receive the electromagnetic energy in a GPS frequency band in the second frequency range.

7. The apparatus of claim 5, wherein the first frequency range is approximately 1930 MHz to approximately 2690 MHz, and wherein the second frequency range is approximately 1575.42 MHz to approximately 1605.375 MHz.

8. The apparatus of claim 5, further comprising an antenna carrier disposed at a top side of the apparatus, wherein the folded monopole element is disposed on the antenna carrier.

9. An apparatus comprising:

a single radio frequency (RF) feed;

a folded monopole element coupled to the single RF feed, wherein the folded monopole element is to receive electromagnetic energy in a first frequency range and to receive electromagnetic energy in a second frequency range, wherein the first frequency range is a wireless area network (WAN) frequency band and the second frequency range is a global navigation satellite system (GNSS) frequency band;

an impedance matching circuit coupled to the single RF feed, wherein the impedance matching circuit comprises:

a first port;

a second port;

a diplexer coupled to the folded monopole element and the first port and the second port, the diplexer to extract out GNSS frequency signals received by the folded monopole element from WAN signals received by the folded monopole element;

pre-matching circuitry coupled between the folded monopole element and the diplexer;

first matching circuitry coupled between the first port and the diplexer; and second matching circuitry coupled between the second port and the diplexer.

10. An apparatus comprising:

a single radio frequency (RF) feed;

a folded monopole element coupled to the single RF feed, wherein the folded monopole element is to receive electromagnetic energy in a first frequency range and to receive electromagnetic energy in a second frequency range;

an impedance matching circuit coupled to the single RF feed, wherein the impedance matching circuit comprises a diplexer;

a second RF feed;

a third RF feed; and a primary transmit and receive (TX/RX) antenna, the primary TX/RX antenna comprising:

a high-band antenna element coupled to the second RF feed, wherein the high-band antenna element radiates or receives electromagnetic energy in a wireless area network (WAN) frequency band in the first frequency range; and a low-band antenna element coupled to the third RF feed, wherein the low-band antenna element radiates or receives electromagnetic energy in a third frequency band that is less than the first frequency range and the second frequency range, and wherein the folded monopole element operates as a high-band WAN secondary receive antenna to receive the electromagnetic energy in the WAN frequency band, and wherein the folded monopole element operates as a global positioning system (GPS) antenna to receive the electromagnetic energy in a GPS frequency band in the second frequency range.

11. The apparatus of claim 10, further comprising:

a fourth RF feed; and a wireless local area network (WLAN) antenna element coupled to the fourth RF feed, wherein the WLAN antenna element is a dual-band WLAN antenna to radiate or receive the electromagnetic energy in a fourth frequency band and a fifth frequency band.

12. The apparatus of claim 11, wherein the folded monopole element radiating or receiving within the first frequency range permits communications in a first plurality of operating bands comprising at least one of band 1, band 2, band 4, wireless communication service (WCS) and band 7 of Long Term Evolution (LTE) networks, wherein the folded monopole element receiving within the second frequency range permits reception of GPS signals, wherein the high-band antenna element radiating or receiving within the first frequency range permits communications in a third plurality of operating bands comprising at least the band 1, the band 2, and the band 4, wherein the-low-band antenna element radiating or receiving within the third frequency band permits communications in a fourth plurality of operating bands comprising at least band 17, band 5, band 8, band 20, and band 29 of LTE.

13. The apparatus of claim 12, further comprising:

a fifth RF feed; and a low-band secondary antenna element coupled to the fifth RF feed, wherein the low-band antenna secondary element radiates electromagnetic energy in the third frequency band, and wherein the low-band antenna secondary element radiating within the third frequency band permits communications in the fourth plurality of operating bands.

14. The apparatus of claim 13, further comprising:

a sixth RF feed; and a near field communication (NFC) antenna coupled to the sixth RF feed, wherein the NFC antenna radiates electromagnetic energy in a sixth frequency band.

15. An antenna structure comprising:

a radio frequency (RF) feed;

a first arm comprising a proximal end coupled to the RF feed and a distal end, the first arm extending from proximal end to the distal end in a first direction;

a widened portion coupled to the distal end of the first arm;

a second arm comprising a second proximal end coupled to the widened portion and a second distal end, the second arm extending from the second proximal end to the second distal end in a second direction that is opposite to the first direction to form a gap between a portion of the first arm and a portion of the second arm; and an extension portion coupled to the widened portion, the extension portion extending in a third direction away from the widened portion, wherein the first arm, the second arm, the widened portion and the extension portion together operate as a folded monopole antenna when current is applied to the RF feed, and wherein the folded monopole antenna is operable to receive electromagnetic energy in a first frequency range and to receive electromagnetic energy in a second frequency range, wherein the second frequency range is a global navigation satellite system (GNSS) frequency band.

16. The antenna structure of claim 15, wherein the first frequency range is a wireless area network (WAN) frequency band.

17. The antenna structure of claim 15, wherein the GNSS frequency band is global positioning system (GPS) L1 band.

18. The antenna structure of claim 15, further comprising a fourth element located at a second corner of a top side of a user device, wherein the first arm, the widened portion, the second arm, and the extension portion are located at a first corner of the top side of the user device, wherein the antenna structure and the fourth element form a secondary receive (RX) antenna structure located at the top side of the user device.

* * * * *